US010299570B2

(12) United States Patent
Kim et al.

(10) Patent No.: US 10,299,570 B2
(45) Date of Patent: May 28, 2019

(54) QUICK RELEASE MODULAR BACKPACK SYSTEM

(71) Applicants: Eric Kim, Anaheim, CA (US); Ramzan Amiri, Anaheim, CA (US); Bryan Furumoto, Anaheim, CA (US)

(72) Inventors: Eric Kim, Anaheim, CA (US); Ramzan Amiri, Anaheim, CA (US); Bryan Furumoto, Anaheim, CA (US)

(73) Assignee: KRE8LABS, INC., Anaheim, CA (US)

( * ) Notice: Subject to any disclaimer, the term of this patent is extended or adjusted under 35 U.S.C. 154(b) by 200 days.

(21) Appl. No.: 15/285,338

(22) Filed: Oct. 4, 2016

(65) Prior Publication Data

US 2018/0092455 A1 Apr. 5, 2018

(51) Int. Cl.
*A45F 3/04* (2006.01)
*A45F 3/10* (2006.01)

(52) U.S. Cl.
CPC ..... *A45F 3/047* (2013.01); *A45F 3/10* (2013.01); *A45F 2003/045* (2013.01)

(58) Field of Classification Search
CPC ..... A45F 3/047; A45F 3/10; A45F 2003/045; A45F 2003/003; A45F 3/04; A45F 3/06; A45F 2003/166
See application file for complete search history.

(56) References Cited

U.S. PATENT DOCUMENTS 3,154,272 A 10/1964 Gold
5,184,763 A 2/1993 Blaisdell et al.
5,249,890 A 10/1993 Bergstrom
5,361,955 A 11/1994 Gregory
5,562,236 A 10/1996 Monzingo
5,564,612 A 10/1996 Gregory
5,639,005 A 6/1997 Chouinard
5,732,867 A * 3/1998 Perkins ..... A45F 3/08 224/271
5,934,927 A 8/1999 Von Neumann
D418,673 S 1/2000 Madsen
6,189,750 B1 2/2001 Von Neumann
6,216,926 B1 4/2001 Pratt
6,626,342 B1 9/2003 Gleason
8,516,732 B2 8/2013 Burnsed, Jr.
8,919,628 B2 12/2014 Jamlang
(Continued)

OTHER PUBLICATIONS

Excerpt from www.gbfans.com taken on Oct. 4, 2016—front view of an ALICE pack frame without pack.
(Continued)

*Primary Examiner* — Corey N Skurdal
(74) *Attorney, Agent, or Firm* — Advantage IP Law Firm

(57) ABSTRACT

A quick release modular backpack system for rapidly shedding load components generally incorporates an essential load support constructed to be releasably secured to a support surface, such as a person's torso, and further incorporates an auxiliary load bearing module and a quick release mechanism having a first position releasably coupling the auxiliary load module to the essential load support with an actuator constructed to shift the quick release mechanism into a second position with a single motion to completely shed the auxiliary load module from the essential load support while the essential load support is retained on the support surface.

20 Claims, 29 Drawing Sheets

(56) References Cited

U.S. PATENT DOCUMENTS 9,420,871 B2 8/2016 Roberts

OTHER PUBLICATIONS

Excerpt from www.media.midway.usa.com taken on Oct. 4, 2016, perspective view of front and side of ALICE pack with frame and pack.
Excerpt from www.images.esellerpro.com taken on Oct. 4, 2016, perspective view of MOLLE pack.

* cited by examiner

QUICK RELEASE MODULAR BACKPACK SYSTEM

BACKGROUND OF THE INVENTION

1. Field of the Invention

The present invention relates to load bearing systems and, more particularly, to backpacks, rucksacks, or other equipment carrying varieties with removable storage components.

2. Background Art

Backpacks or rucksacks provide a versatile means of transporting equipment and supplies for a variety of activities including recreational hiking as well as for first responder and military focused scenarios. Traditional civilian use backpacks have two vertical padded shoulder straps, a chest strap, and a waist belt connected to a large fixed volume pouch that may include fixed interior or exterior pockets or pouches for organizing the articles to be transported. Pack sizes are typically selected depending on the time duration and distance of the trip. Recreational backpacks, particularly those used for extended outings, may have large carrying capacities, but are generally lightweight and may use a frame system to stabilize and distribute weight of the contents.

However, these recreational backpacks frequently suffer from being too open, generally consisting of one large main compartment with a variety of small pouches on the exterior of the main compartment. In addition, the carrying mechanisms for recreational backpacks utilizing traditional shoulder straps, hip belt, and sternum strap often result in bruised hips and raw shoulders due to the weight of the contents being focused on the hips and the shoulder straps and moving during use, thereby abrading the wearer's shoulders.

While most innovations relating to backpacks tend to focus on comfort, organization, and transferring the load to the user's frame, other approaches focus on the modularity of the pack itself. Given the variety of scenarios a user may face, the search for a comprehensive modular backpacking system is ongoing in both the civilian and military sectors. For example, one early attempt at a modular hiking backpack may be found in U.S. Pat. No. 5,564,612 to Gregory. In general, the Gregory backpack includes a pair of contoured side rails and three separate molded plastic support members removably attached to the rails. The upper support member includes a structure for carrying much of the weight of the carry bag. The carry bag includes hook and loop fasteners on fabric strips for securing the bag to the rails. The upper support member and other support members include slots and ports for attaching various straps and pads. One of the support members includes a flexible section to which the waistband and pad structure is attached, thereby providing flexibility to accommodate hip movement of the wearer. Separate back and lumbar pads are strapped to the support members. The separate plastic support members may be removed from one pair of contoured side rails and fastened to a pair of side rails of different length to accommodate wearers of different heights and proportions.

However, to release the carry bag from the rails, the user must completely remove the assembled pack or have a second user assist him or her as there are at least eight hook and loop fasteners and two opposing socket connectors with spring loaded fasteners securing the U-shaped support member to the rails to separate the carry bag to the rails. None of these fasteners are easily accessible while the pack assembly is worn.

Another solution was provided in U.S. Pat. No. 6,189,750 to Von Neumann which discloses a modular backpack with four bags or units connected together by zippers or snaps or the like. The bags may also be used separately or in various subcombinations. The bags comprise a main bag with shoulder straps useable as a backpack, a middle bag connectable to the bottom of the main bag, and a lower bag connectable to the bottom of the middle bag or directly to the bottom of the main bag. The middle bag may be used alone or together with a lower bag as a waist bag. A purse is removably attached to the main bag. However, the Von Neumann pack is not sturdy or rugged enough for large loading bearing capacity requirements such as first responder, firefighter, police, or military applications. As with other solutions, the strap and zipper system of attaching modular components is cumbersome and adds time to remove the components. In addition, the pack must typically be removed in its entirety for a single user to add or remove storage components as the strap access for attaching the middle and lower compartments to the upper compartment is on the rear facing surface of the pack when worn.

Yet another solution is provided in U.S. Pat. No. 6,626,342 to Gleason. Instead of straps and zippers as in the Von Neumann pack, Gleason introduces hook and loop style fasteners for securing a pack bag to a modular pack frame. The modular pack frame includes a generally flexible frame sheet that is fixed to a rigid support bar at the center of the frame that is contoured to mimic the shape of a user's backbone. The frame sheet is similarly curved and adapts to fit the remainder of the user's back. A pad overlies the sheet and extends throughout the pack frame. Reinforcement members are positioned in the pack frame and pack bag to prevent distortion of the pack frame and to concentrate the load of the pack toward the lumbar region and comfortably distribute the remainder of the load to the user's shoulders, hips, and other portions of the back. As with other packs, the user would have to remove the entire pack to pull apart the portions fastened by the hook and loop and strap fasteners. The incorporation of multiple fasteners also adds to the separation time.

A more recent approach to a modular backpack may be found in U.S. Pat. No. 8,919,628 to Jamlang. The approach in this patent is a modular backpack that generally includes a harness, a container, and a cover. The harness consists of a pair of shoulder straps and a waist strap as with many conventional backpacks. A container may be secured to the harness using a set of four bayonet clips to releasably couple the container to the harness. A cover may then be clipped to the rear facing surface of the container. The container may be detached from the harness by unbuckling the four clips. The container may then be used separately from the harness. Different containers, covers, and compartments may be attached to provide different capacities and organizational features.

However, the entire Jamlang style pack including the harness would have to be removed to undo the container or a second person would be required to assist the wearer to remove the container from the harness. Removing the entire modular backpack to undo the container also removes essential components from the user while unclipping the container. Moreover, the unclipping the four buckle system is time consuming. In addition, the buckles are located at the ends of straps thus increasing the likelihood of the container shifting relative to the harness resulting in less control and less stability while in use. This issue arises despite the ability to cinch up the straps and buckles.

As expected, the military has spent a lot of time and effort to develop a load bearing system to accommodate the general and specialized needs of being in the field. To allow more gear to be added to a standard backpack, the military has come up with a number of solutions. One standard developed in the mid-1950s was the All-purpose Lightweight Individual Carrying Equipment system (also known as the ALICE pack). The ALICE system retained the concept of separate fighting and existence loads that was refined in the mid-1950s. The most important point in the fighting and existence loads concept is that an infantry rifleman should carry only the items necessary to complete the immediate mission at hand. The load an infantry rifleman carries should not include any other item that can be carried another way. Because the type of mission, terrain, and environmental conditions influences the clothing and individual equipment requirements, the unit commander typically prescribes to the infantry rifleman the essential items. The primary purpose of the fighting and existence loads concept is to lighten an infantry rifleman's load.

The typical individual fighting load is made up of essential items of clothing, individual equipment, small arms, and small arms ammunition that are carried by, and are essential to, the effectiveness of the combat infantry rifleman and the accomplishment of the immediate mission of the unit when the infantry rifleman is on foot. Normally these items are carried on the individual equipment belt and individual equipment belt suspenders. As an example, the ALICE system fighting load may comprise the following components: individual equipment belt, entrenching tool carrier, field first aid dressing case, small arms ammunition case, water canteen cover, individual equipment belt suspenders.

The typical individual existence load consists of items other than those in the individual fighting load which are required to sustain or protect the infantry rifleman, which may be necessary for the infantry rifleman's increased personal and environmental protection, and which the infantry rifleman normally would not carry. When possible, the individual existence load items are transported by means other than man-carry. Otherwise both the fighting and existence loads are carried by the infantry rifleman. Individual existence load items are usually carried in the field pack. As an example, the ALICE system existence load may comprise the following components: field packs and field pack covers, a field pack frame, a cargo support shelf, webbing straps for cargo, lower back strap and waist strap webbing, a left shoulder strap with quick release webbing, and a right shoulder strap without quick release. The ALICE system also includes a medium field pack with a main compartment that closes by means of a drawstring secured by a plastic cord clamp. A radio pocket may be located against the back on the inside. Equipment hangers are located above each outside pocket and on each side. An envelope pocket is located at the top, back of the pack and padded with spacer cloth, into which the field pack frame is inserted when the field pack is used on the field pack frame. Buckles and straps at each side near the bottom are used for anchoring the field pack to the field pack frame. Two rectangular wire loops located at the top back of the field pack and D rings on each side at the bottom of the field pack are used to provide shoulder strap attachment when the field pack is carried without the field pack frame. A waterproof bag is supplied for the main compartment and each of the three outside pockets for keeping equipment dry.

The ALICE pack may further include a large field pack similar to the medium field pack and a field pack frame used as a mount for either the medium field pack or the large field pack. The frame comes with all straps and is of aluminum construction. The cargo support shelf is used to support bulky loads such as water, gasoline, and ammunition cans, field rations, and radios and is also of aluminum construction.

The ALICE pack was eventually phased out in favor of the Modular Lightweight Load-carrying Equipment or MOLLE pack, which is the current generation of load-bearing equipment and backpacks utilized by a number of armed forces. The MOLLE pack's modularity is derived from the use of Pouch Attachment Ladder System (PALS) webbing as rows of heavy-duty nylon stitched onto the vest to allow for the attachment of various MOLLE-compatible pouches and accessories. The PALS consists generally of a grid of webbing or straps arranged around the exterior of the primary pack body and through which individual pouches with one or more fastening straps may be buckled together. The fastening straps are interwoven between the webbing on each of two pieces and finally snapped into place, making for a very secure fit which can be detached with moderate effort. For example, pouches of various utility that can be attached wherever PALS webbing exists. One type is a "sustainment pouch", which holds three meals ready to eat (MREs). MOLLE pouches are commonly used to carry ammunition, gas masks, batons, flares, grenades, handcuffs and pepper spray, and custom pouches include MOLLE-compatible pistol holders, hydration pouches and utility pouches. These pouches are normally secured through the use of straps, Alice clips, Natick snaps, or speedclips. The PALS is also commonly used to attach items such as holsters, magazine pouches, radio pouches, knife sheathes, and other gear. A wide variety of pouches are commercially available, allowing soldiers to customize their kit.

While PALS was first used on MOLLE rucksacks, the webbing system is now found on a variety of tactical equipment, such as the American Improved Outer Tactical Vest (OTV), Interceptor body armor, USMC Improved Load Bearing Equipment (ILBE) backpack and Modular Tactical Vest (MTV). The Marines introduced the ILBE that included individual load carriage equipment, individual hydration systems (Source One Hydration), and individual water purification to replace MOLLE system.

However, despite these organizational and load bearing advantages of the MOLLE and ILBE packs, a big issue, especially in a military, emergency responder, or other first responder settings is the ability to shed the pack as quickly as possible while retaining essential components such as those secured to the underlying MTV while providing variable storage capacity and improved stability. A full military backpack may weigh as much as 75 to 100 pounds or more. Factor in that the soldier is also carrying a helmet and weapon that introduces several additional pounds and it is easy to imagine the burden in getting from one place to another while carrying such weight. In the military, units that come under fire have to make split decisions and react as fast as possible to mitigate unfavorable conditions, One of these reactions is shedding the backpack so the soldier can move more swiftly. With conventional packs, the weapon (rifle) is typically carried with a strap around the neck of the soldier and available to move into a fire ready position. The rifle is donned after the backpack is secured using a waist belt and chest strap. Thus, in use, the soldier must first remove the strap from around his or her neck to move the rifle out of the way and then unbuckle the chest strap and waist belt to shed the pack. Alternatively, the soldier must negotiate the shoulder straps off his or her torso while holding the rifle clear. Either approach is cumbersome and very timely. Needless to say, time is critical in a firefight. In some situations soldiers have cut their pack straps for speed leaving the pack useless and irreplaceable without new straps.

In addition, the soldier may also get into a prone position to reduce his or her profile while under attack. Attempting to remove a pack while in the prone position is difficult to say the least.

In addition to the critical time issue, shedding the entire backpack leaves the soldier with only a weapon as the entire pack and everything attached to the pack is left behind as the soldier heads for cover and away from the pack. Moreover, in a firefight, having water is critical to success and often the water is left behind with the remainder of the shed pack.

The technical solutions discussed above such as the multi-clip connection used in recreational packs such as that found in Jamlang simply do not allow for the wearer to shed non-essential components while retaining essential components. Instead, the user would have to shed the entire pack, harness and all, or have a second person unclip all four clips to remove the container from the harness. Similar problems are faced when donning the MOLLE or ILBE packs.

One other quick shedding solution may be found in U.S. Pat. No. 3,154,272 to Gold. The main focus of Gold is what happens at the end of a parachute jump, particularly with water landings or high wind conditions where the parachute drags the trooper into an undesirable situation. As one solution to this problem, the Gold patent describes a quick divestible parachute harness that allows the user to pull a grip associated with a cable housed in a conduit leading to a juncture box to release a set of detents associated with four separate cables to release four fittings to divest the parachute trooper completely from the harness, emergency pack, back pack, and combat equipment at the end of the jump. However, this may create a drawback as many of these necessities are required for the trooper to continue his task. While the Gold patent is primarily concerned with addressing the unique situation of rescuing a parachute trooper at the expense of shedding essential equipment, the complete divestiture of essential items is not desirable in every load bearing backpack scenario.

Finally, another drawback of conventional load bearing systems is that once the pack is filled, the user is generally stuck with those contents in the field. Unfortunately, the situation may change once the soldier arrives at his or her destination. Unpacking and/or repacking takes time and many items may remain that may be unnecessary, simply adding weight and slowing the soldier down.

While the foregoing devices may perform well under certain conditions, what is needed is a load bearing system that allows the user to easily and selectively don as well as shed or divest one or more components quickly without assistance while retaining essential components to perform a critical task as well as allowing the swapping or exchanging of one or more modular components that may be tailored to a particular backpacking, first responder, or military type situations the user is facing.

SUMMARY OF THE INVENTION

In accordance with the principles of the present invention, a quick release modular back system may be provided with a primary load support constructed to be releasably secured to a support surface and an auxiliary load bearing module and a quick release mechanism having a first position releasably coupling the auxiliary load module with the primary load support, the quick release mechanism including an actuator constructed to shift the quick release mechanism into a second position with a single motion to completely shed the auxiliary load module from the primary load support while the primary load support is releasably secured to the support surface.

In another aspect of this system, an auxiliary load bearing module, either the same one or a replacement may be replaced on the primary load support.

In yet another aspect of the system, the auxiliary load bearing module may be pivotally coupled to the primary load support and constructed to rotate away and completely off the primary load support.

Another aspect of the system is the incorporation of fluid bladder that may be protected between the primary load support and the auxiliary load bearing module and retained with the primary load support when the auxiliary load bearing module is shed.

In another embodiment, the auxiliary load module may be shed by the user without reliance on a second party.

Methods for rapidly shedding an auxiliary load while retaining an essential primary load are also disclosed herein.

All of the embodiments summarized above are intended to be within the scope of the invention herein disclosed. However, despite the discussion of certain embodiments herein, only the appended claims (and not the present summary) are intended to define the invention. The summarized embodiments, and other embodiments and aspects of the present invention, will become readily apparent to those skilled in the art from the following detailed description of the preferred embodiments having reference to the attached figures, the invention not being limited to any particular embodiment(s) disclosed.

DETAILED DESCRIPTION OF THE PREFERRED EMBODIMENTS

Overview of the Quick Release Modular Backpack System (QRMBS):

With reference to the figures, an exemplary embodiment of a quick release modular backpack system (QRMBS), generally designated 30 (FIGS. 1-6), is described herein. In general terms, the QRMBS generally includes a chassis (also referred to a primary load support, essential load support, or back support member), generally designated 32, releasably coupled to a carrier (also referred to as an auxiliary load bearing module), generally designated 34, by a quick release mechanism, generally designated 36 (FIGS. 13-14), that may be selectively actuated by the wearer of the QRMBS to fully release, shed, or divest the carrier from the chassis while the chassis and any attached essential components are retained by the wearer. Both the chassis and carrier may support one or more exchangeable compartments, pockets, covers, or pouches, for organizing and transporting articles such as equipment or supplies that correspond with a mission, whether recreational, first responder based, or military.

Figure 2:
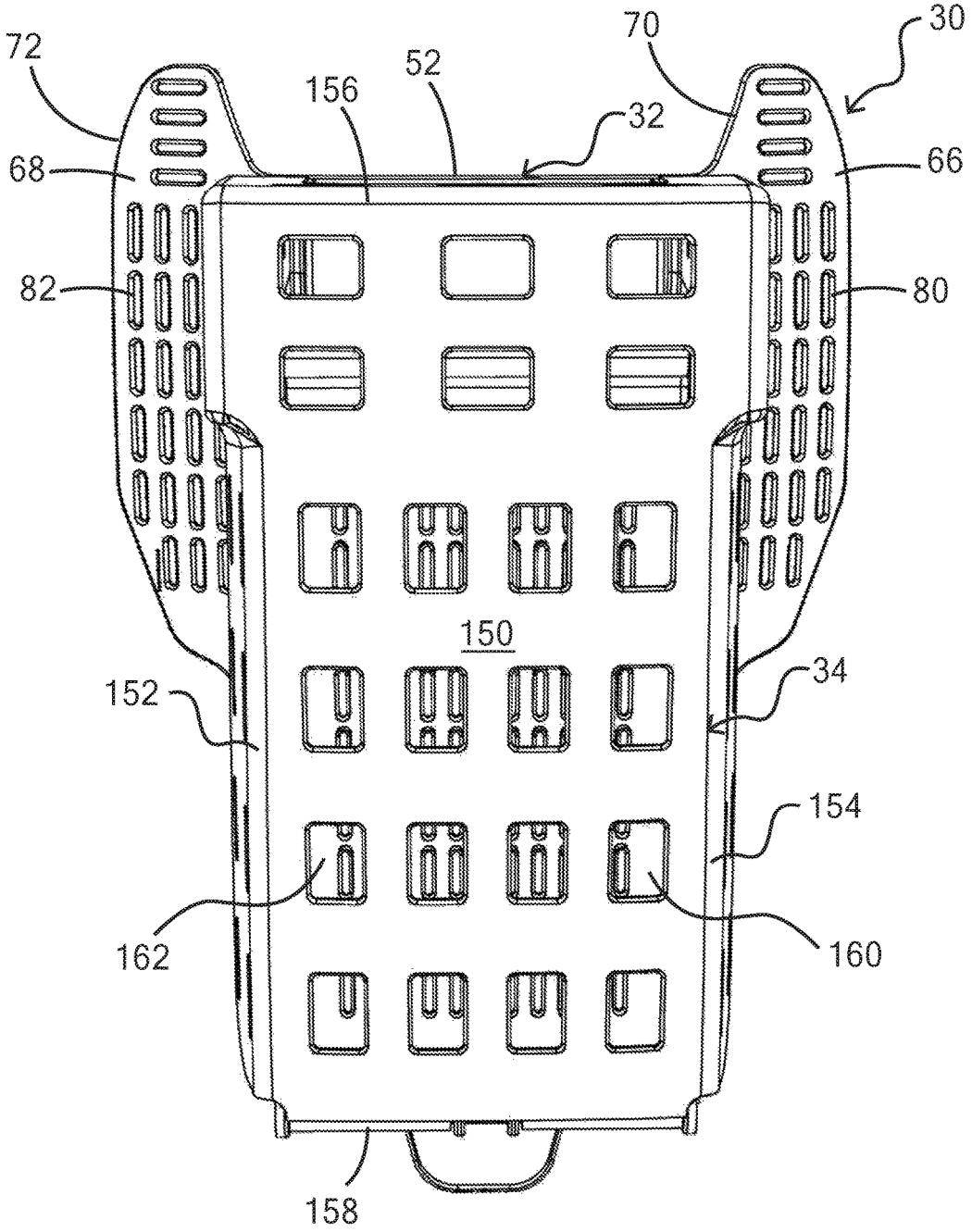
FIG. 2 is a rear view of the quick release modular backpack system of FIG. 1, in enlarged scale.
Figure 3:
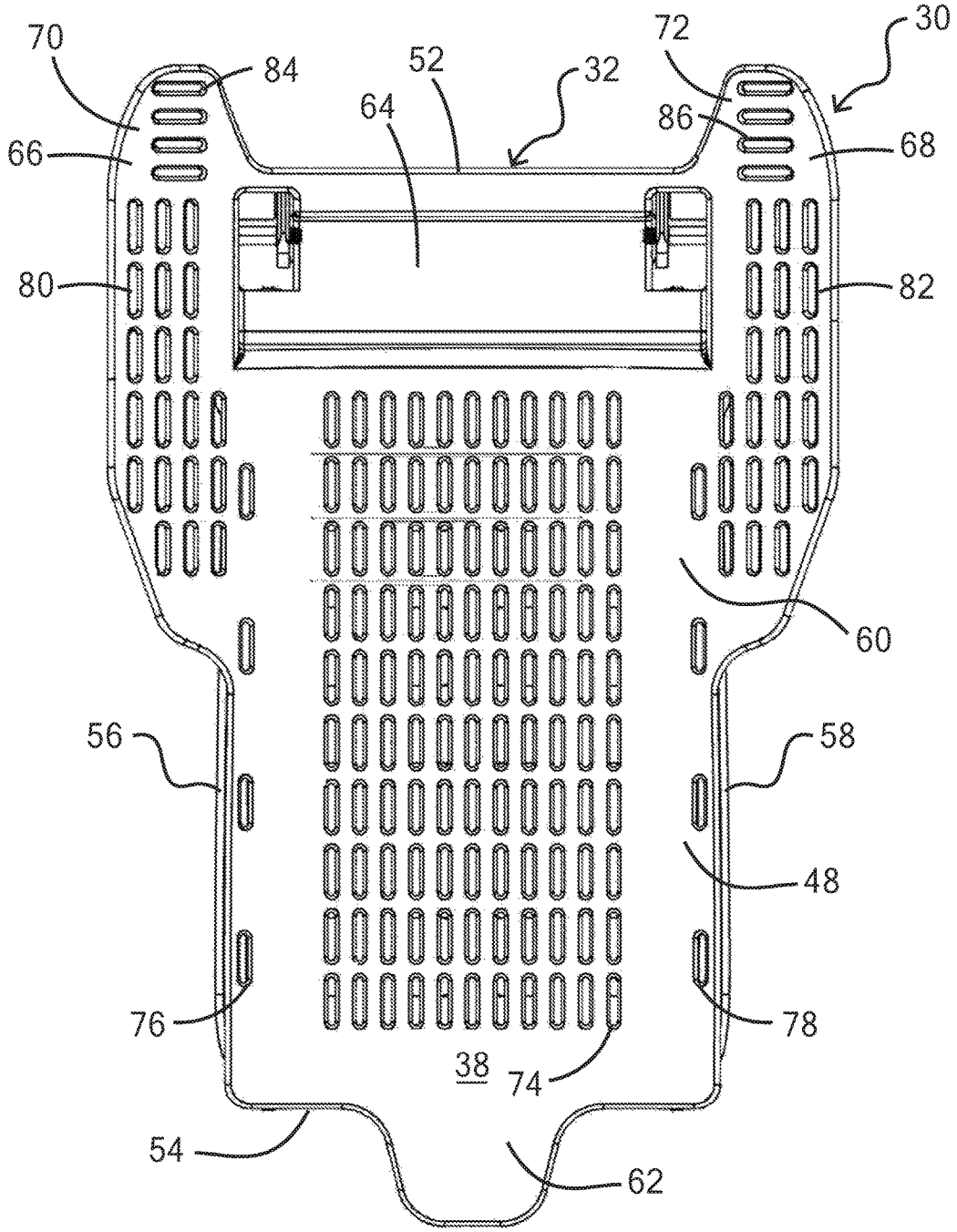
FIG. 3 is a front view of the quick release modular backpack system of FIG. 1, in enlarged scale.
Figure 4:
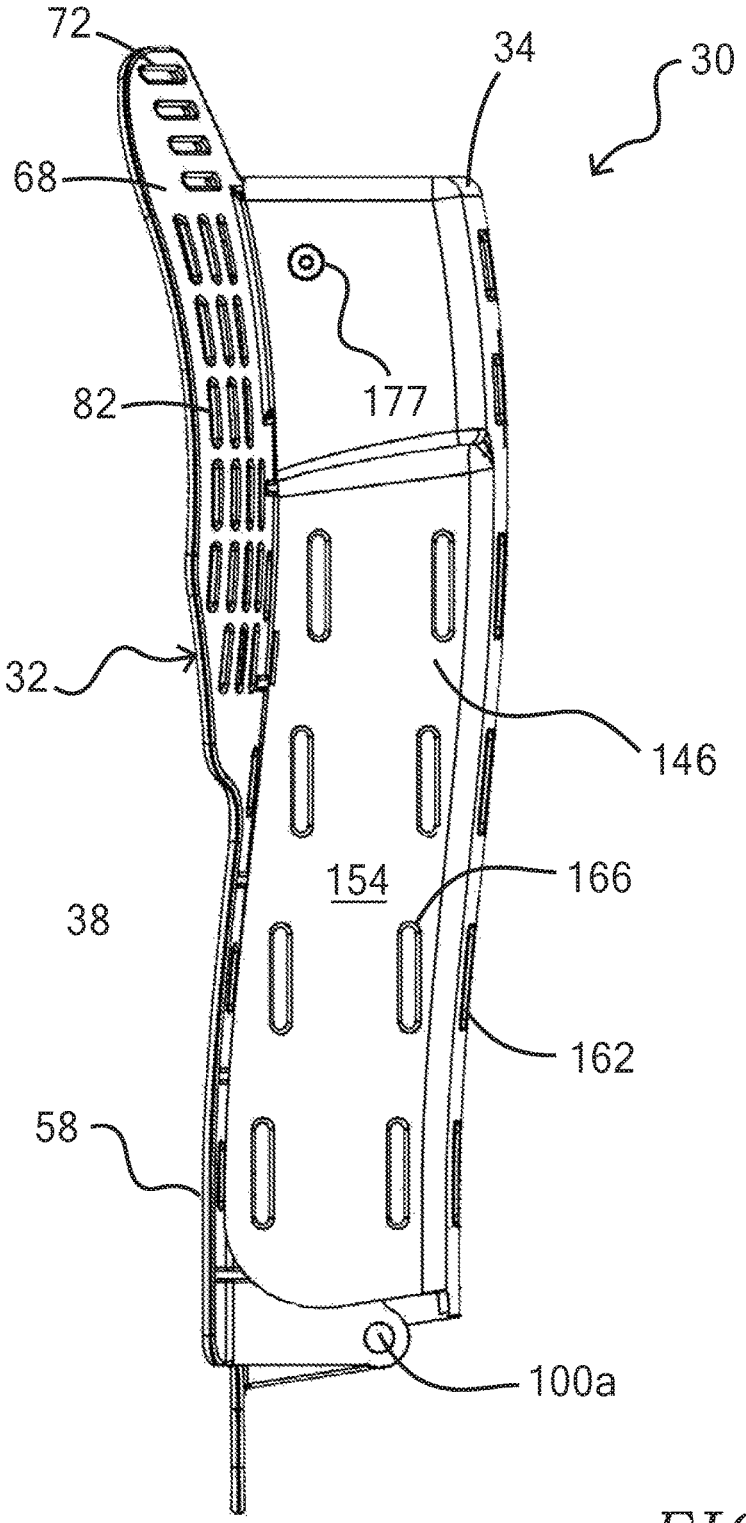
FIG. 4 is a right side view of the quick release modular backpack system of FIG. 1, in enlarged scale, the left side view being substantially identical.
Figure 5:
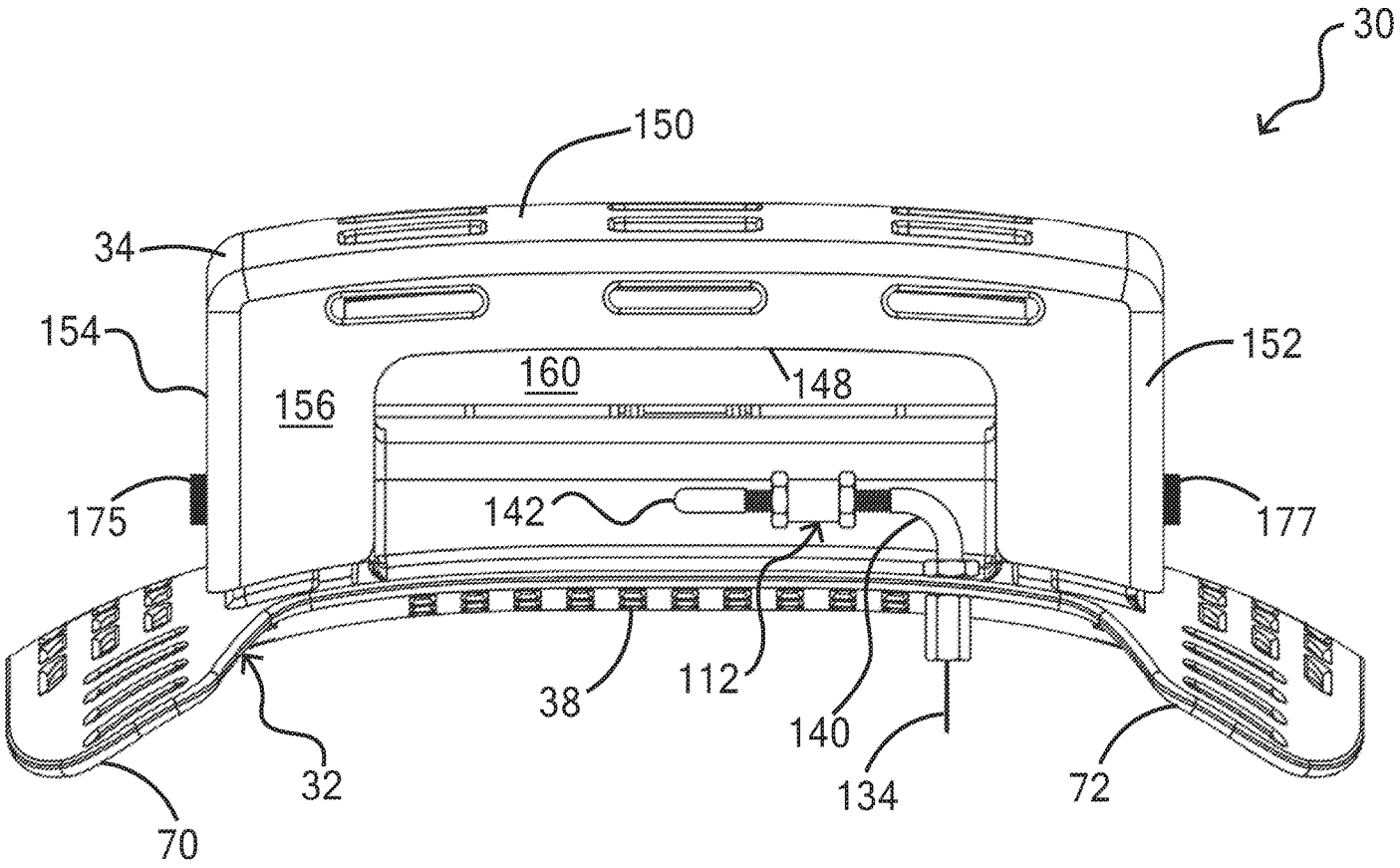
FIG. 5 is a top view of the quick release modular backpack system of FIG. 1, in enlarged scale.

It will be appreciated that the front of the QRMBS 30 and its respective components are defined as the surface that faces the back of the wearer while donned while the rear of the QRMBS and its respective components are defined as the surface facing a person standing behind the user when the QRMBS is donned. For example, FIG. 3 depicts the front of an assembled QRMBS while FIG. 2 depicts the rear of an assembled QRMBS. More details regarding the QRMBS components follow.

Figure 8:
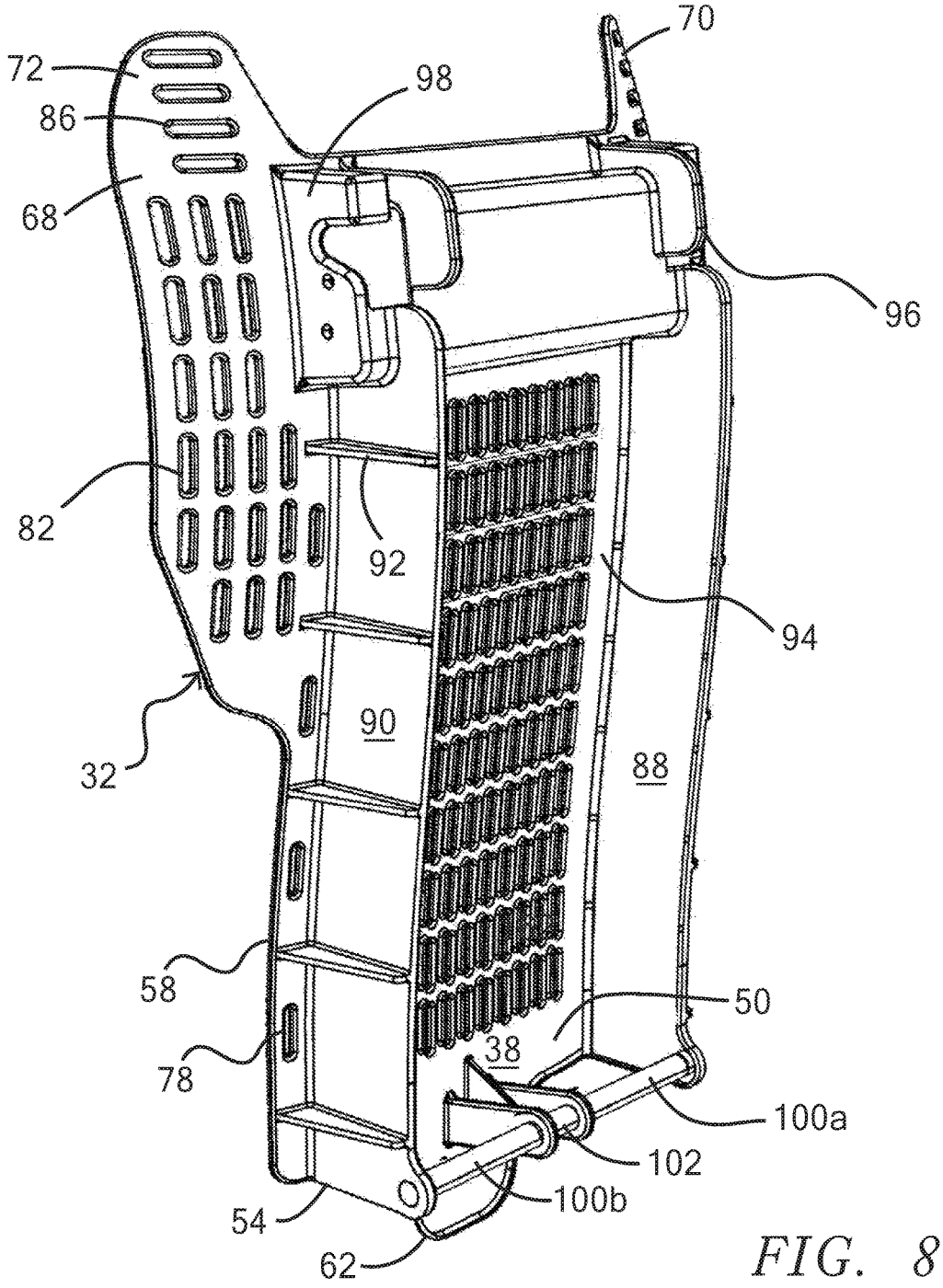
FIG. 8 is a similar view as in FIG. 1 with the carrier removed leaving only the chassis.

Chassis:

Referring now to FIGS. 1-6 and 8 wherein FIGS. 1-6 illustrate an exemplary chassis 32 releasably coupled to the carrier 34 while FIG. 8 depicts a standalone chassis from a perspective rear view, the chassis 32 in this exemplary embodiment is provided in the form of a rigid contoured back support 38 that together with a pair of left and right shoulder straps 40 and 42 (FIG. 15), respectively, and left and right waist belt components 44 and 46, respectively, forms the primary or essential load bearing component 32 of the QRMBS 30. It will be appreciated that the chassis can take the form of a solid plate for additional support or protection or the form of a more open frame to lighten the overall weight of the chassis.

With continued reference to FIGS. 1-6 and 8 concerning the chassis 32 construction, the chassis provides a perforated load bearing support with a front surface 48 (FIG. 3), a rear surface 50 (FIG. 8), a top edge 52, bottom edge 54, left side 56, and a right side 58. From the front as shown in FIG. 3, the chassis includes a central region 60 that extends downwardly into a tail region 62 and an upper release mechanism anchor region 64. The central region 60 is positioned between laterally opposing left and right wings, 66 and 68, respectively, that have upwardly projecting extensions 70 and 72 that extend higher than the anchor region 64. The central region includes a matrix of vertically arranged slots, one of which is designated 74 in FIG. 3, and a set of four left and right side slots, with representative slots designated 76 and 78, respectively. The left and right lateral wings 66, 68 also provide a cluster of respective slots, with representative slots designated 80 and 82, in the lower portion and a set of four horizontally projecting slots, with representative slots designated 84 and 86, respectively. These chassis slots provide retention surfaces for securing and adjusting the upper and lower straps of each shoulder strap 40 and 42, respectively, By incorporating the raised upper extensions 70 and 72 of each lateral wing 66 and 68, respectively, the user may select the best slot for raising as much of the load off their frame as possible. The central region slots 74 of the chassis allow air to pass through for cooling purposes, lighten the overall load, and yet remain small enough to provide ballistic protection. These slots 74 also provide an attachment region for a hydration bladder 198 (FIGS. 19B-19C) or other essential items as will be described below.

Figure 10:
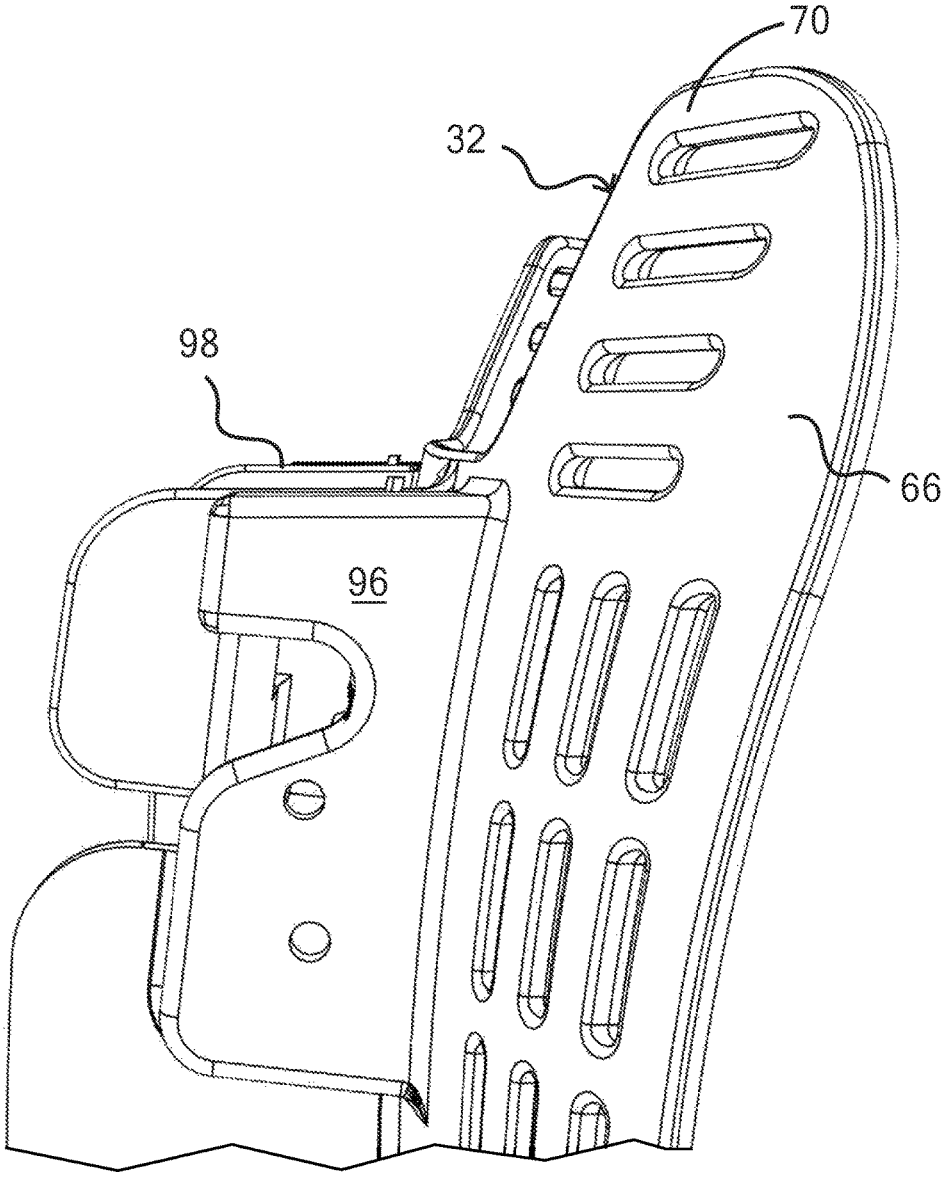
FIG. 10 is a close up perspective side view of a release mechanism receptacle of the quick release modular backpack system of FIG. 1 without the release mechanism.
Figure 11:
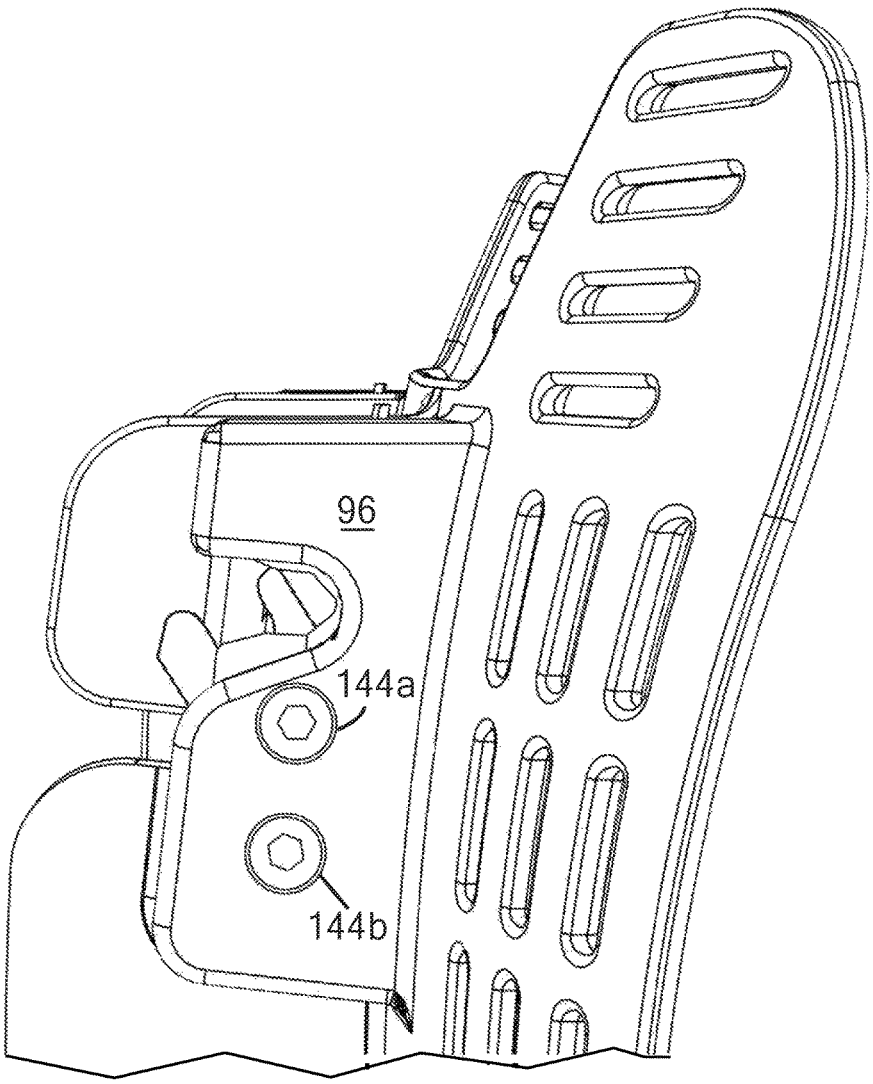
FIG. 11 is the same view as in FIG. 10 with the release mechanism in an open, release, or ready to receive configuration.
Figure 12:
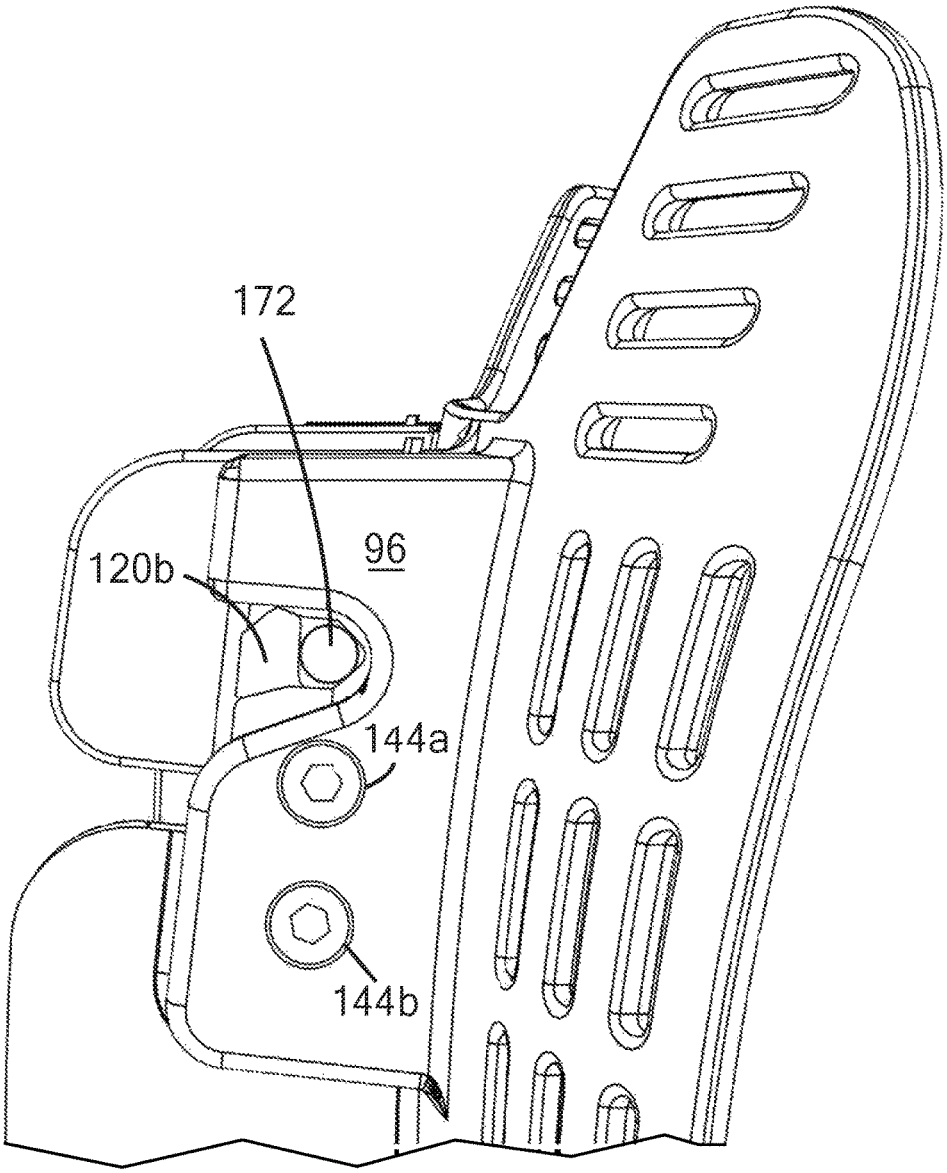
FIG. 12 is the same view as in FIG. 11 with the release mechanism in a closed or capturing configuration with an exemplary capture bar.

As shown in FIG. 8, the rear surface 50 of the chassis 32 includes a left sidewall 88 and a right sidewall 90 extending rearwardly from the main support plate 38. These sidewalls include stiffening ribs with an exemplary rib designated 92 and cooperate to define a compartment 94 or channel therebetween. Above the top of each sidewall 88, 90, is located a corresponding catch support 96 and 98, respectively, to receive a corresponding portion of the quick release mechanism 36. As shown in FIGS. 10-12, the catch supports 96, 98 each provide a channel for seating portions of the quick release mechanisms, which are fastened to the catch supports using bolts or other suitable fasteners. Near the opposing lower edge 54 of the chassis 32 and extending from the lower region of each sidewall 88, 90, respectively, is a pair of left side and right side pivot points 100*a*, 100*b* in the form of captured rods or cylinders projecting transversely across the chassis from the left sidewall to the right sidewall with a short gap 102 halfway across the chassis supporting the interiors of each rod. The pivot points provides a rest on which a carrier 34 may be pivotally and releasably mounted as will be described below.

Figure 15:
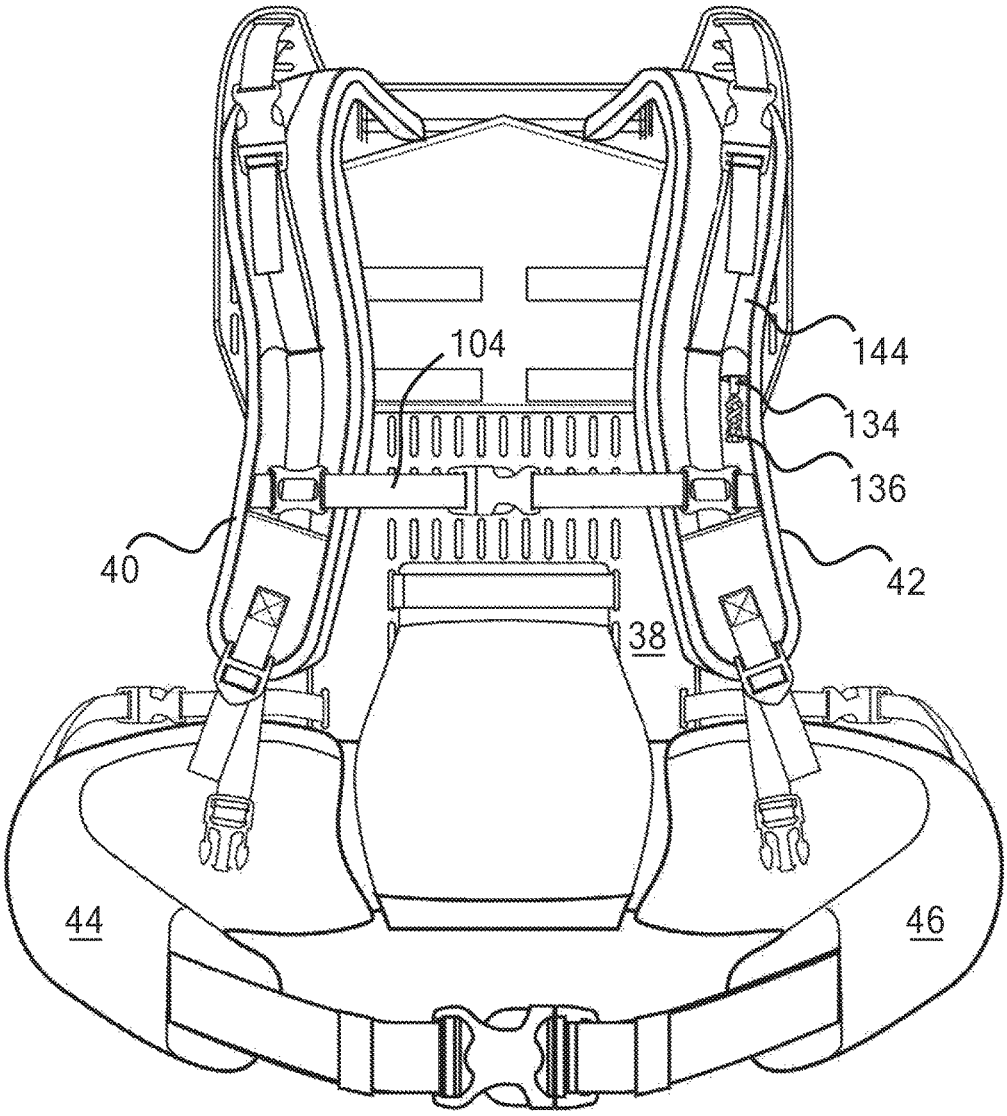
FIG. 15 is a front view of the quick release modular backpack system of FIG. 1 with the addition of a pair of shoulder straps, a waist belt, and a chest strap as would be worn in the field.

Referring now to FIG. 15, the chassis 32 may be releasably secured about the torso of a user with a set of shoulder straps 40 and 42 while left and right waist belt components 44, 46, may be releasably coupled together to facilitate positioning the QRMBS on the user's hip bones to take off some of the load on the user's shoulders due to the shoulder straps. A chest strap 104 connecting the left and right shoulder straps may also be used. Each releasable retention component (shoulder strap, waist belt, and chest strap) is adjustable to accommodate different sized users. In addition, the back support plate 32 may be contoured or form fit to more closely resemble the user's backside. Padding (not shown) may be used between the back support plate and the user's backside as well to provide additional comfort. It will be appreciated that the primary load bearing member 32 as shown in FIG. 15 may be worn over a tactical vest such as a MTV or other suitable undergarment.

Figure 9B:
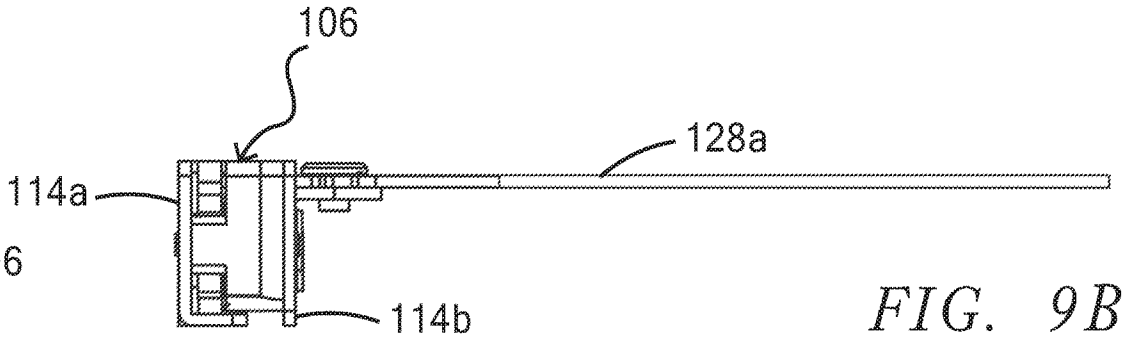
FIGS. 9A-C provide right side (FIG. 9A), top (FIG. 9B), and rear (FIG. 9C) views of an exemplary release mechanism that may be used with the quick release modular backpack system of FIG. 1.
Figure 9C:
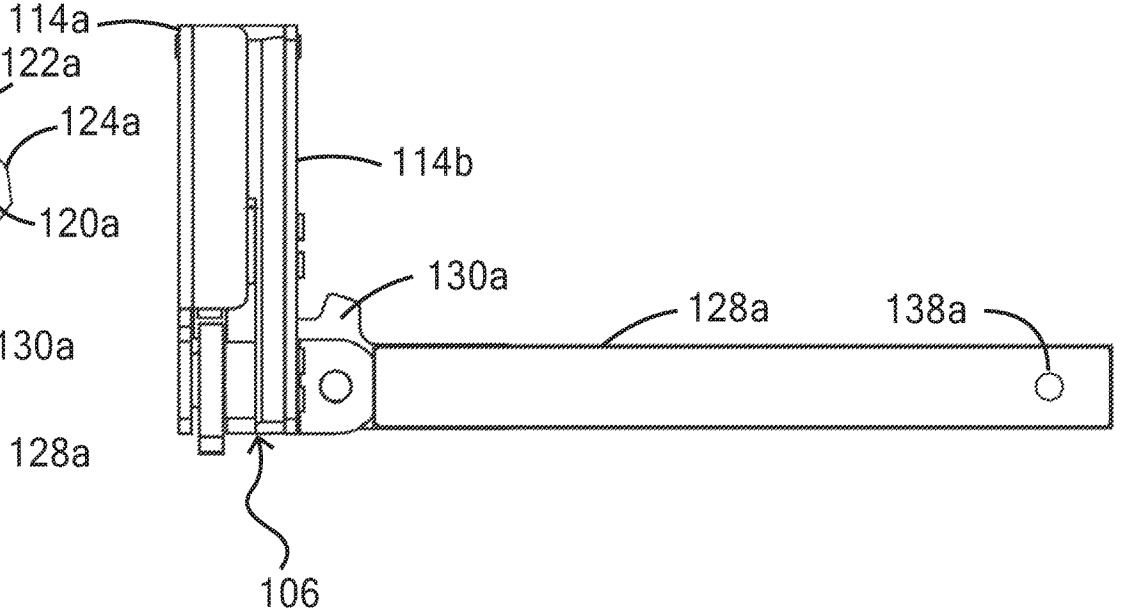
Figure 9A:
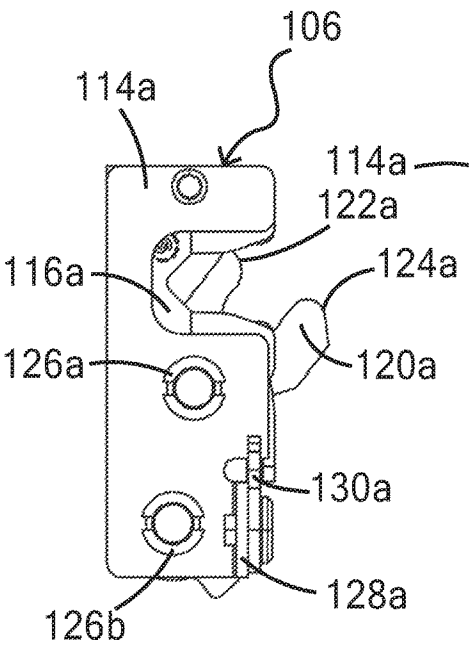

Exemplary Quick Release Mechanism:

Referring now to FIGS. 9A-14, the exemplary quick release mechanism 36 (FIGS. 13-14) will now be described in more detail. The quick release mechanism 36 generally includes a pair of left and right catches 106 and 108, respectively, an interlocking release bar set 128*a*, 128*b* (FIGS. 13-14), and an actuator 112 in communication with the catches via the release bar set. An individual exemplary catch or capturing element 106 is shown in FIGS. 9A-9C with the understanding that both catches are constructed in an identical manner. The catch includes spaced apart sidewalls 114*a*, 114*b*, respectively with each sidewall including a capturing notch 116*a* (right side not shown), respectively. Between the sidewalls is pivotally secured a hook element 120*a* with an inner tooth 122*a* and an outer tooth 124*a* for capturing a corresponding capture bar on the carrier as described below. The sidewalls are secured together using bolts or rivets 126*a*, 126*b*, one of which the hook element 120*a* may rotate about. An elongated release bar 128*a* provides a detent 130*a* constructed to restrict the rotation of the hook 120*a*. The position of the detent generally determines whether the hook is released or not. At the distal end of the elongated release bar is a hole 138*a* through one end 132 of the actuator, generally designated 112 (FIGS. 13-14), is passed and anchored to. The respective elongated release bars 128*a*, 128*b* of the two catches 106 and 108 are joined together at one end by the actuator 112.

Figure 13:
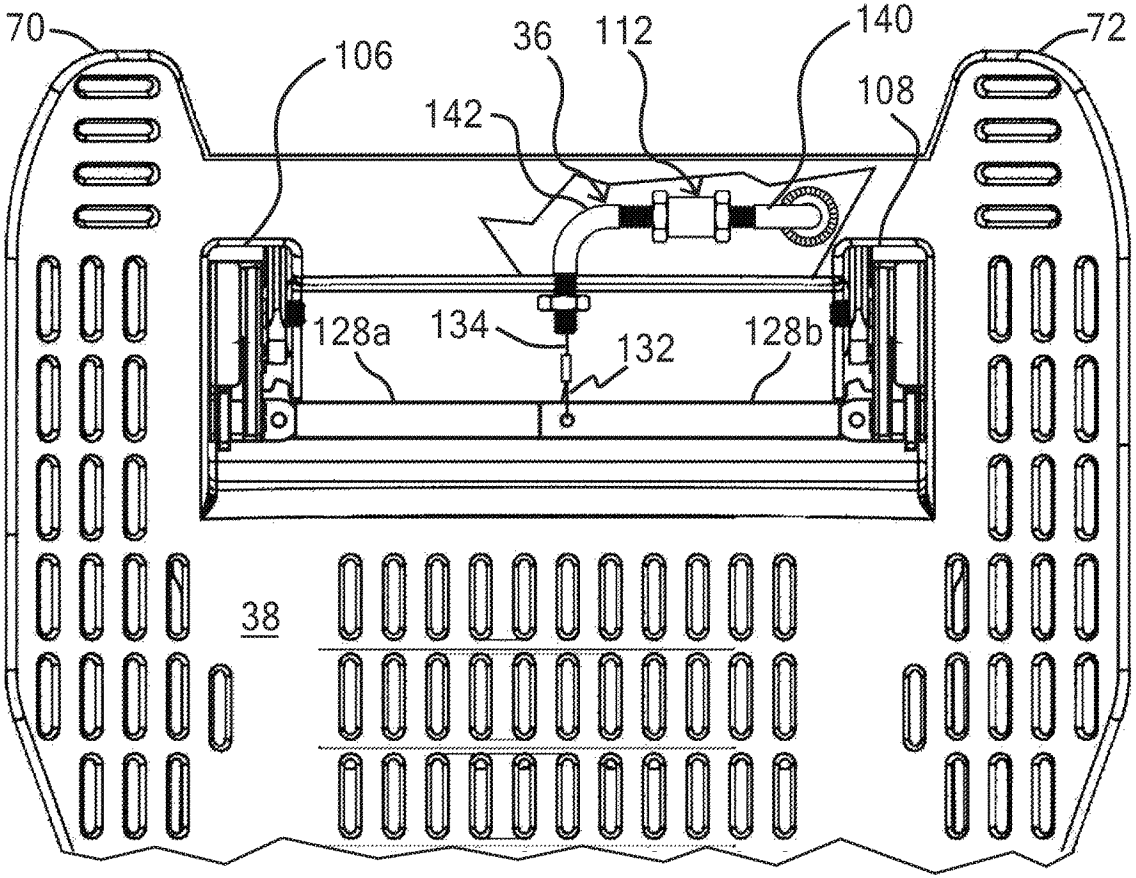
FIG. 13 is a partial view of the quick release backpack system taken from FIG. 3 with the quick release mechanism installed in a closed or capturing configuration.

In this exemplary embodiment, the actuator 112 includes a cable 134 (FIGS. 5, 13-15) that connects the distal ends of the release bars 128*a*, 128*b* to a handle 136 (FIG. 15) or grip that resides within grasping distance of the user when the QRMBS 30 is donned. The actuator cable 134 passes through a fixed sleeve that includes a first leg 140 that projects transversely across the chassis to turn downwardly in a bent section 142 to face the overlapping distal ends of the release bars 128*a*, 128*b* as shown in FIG. 13. The holes 138*a* and 138*b* of each elongated release bar 128*a* and 128*b*, respectively, are generally aligned with one end of a cable anchor 142 at the end 132 of the cable 134 to the overlapping release bars. The cable passes through the fixed sleeve 140, 142 and then is fed through a strap sleeve 144 (FIG. 15) to dispose the handle 136 within easy reach of the person wearing the QRMBS 30.

As shown in FIGS. 11-12, bolts 144*a*, 144*b* are used to secure the quick release catches 106 and 108 within their respective catch supports 96 and 98 and retain the catches on the chassis 32 in this exemplary embodiment. The hook elements 120*a*, 120*b* of each catch 106, 108 can rotate between an open, release, or ready to receive position as shown in FIG. 11 or a capturing position as shown in FIG. 12 depending on the position of the release bars as determined by the action of the actuator cable 134.

Figure 6:
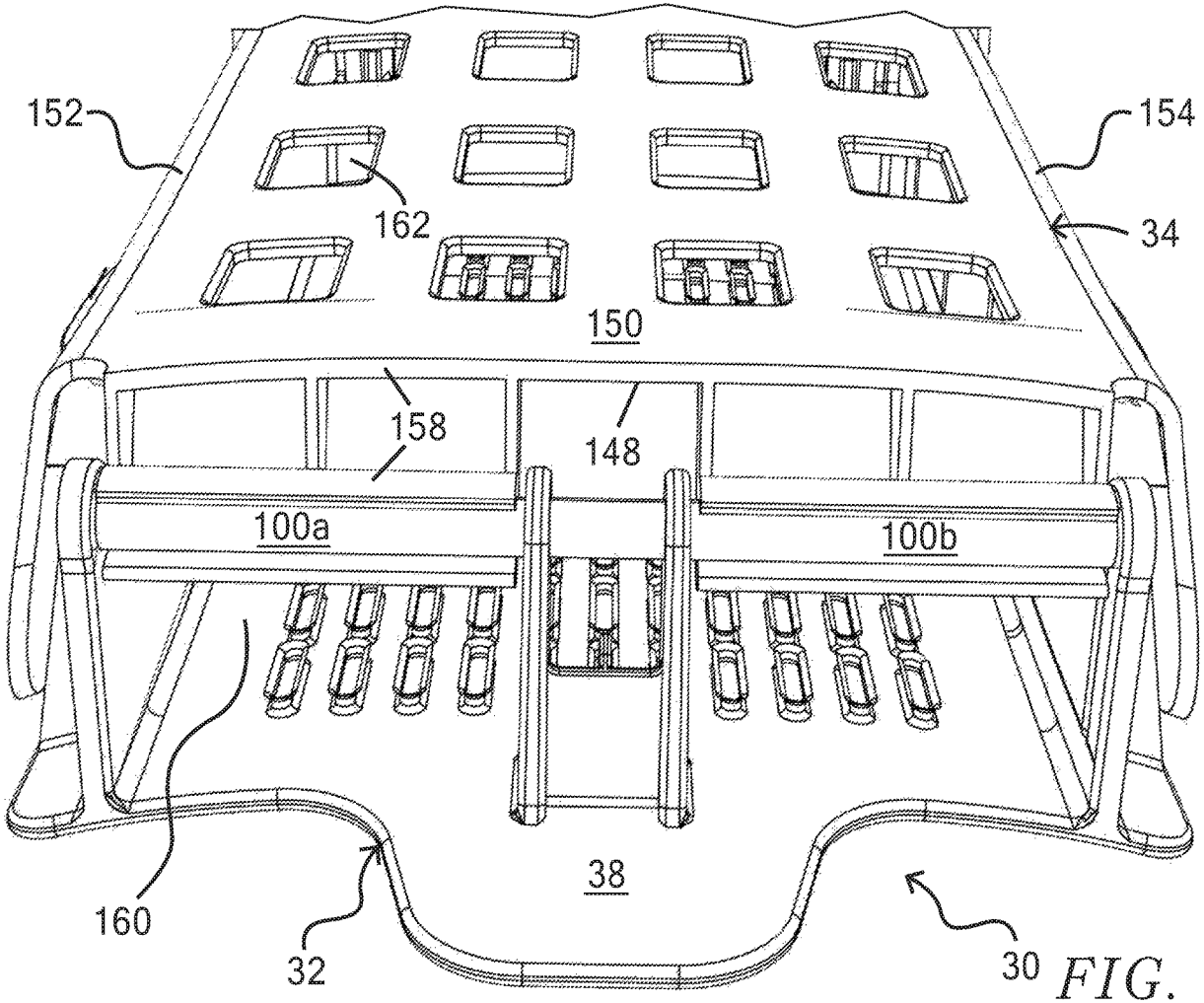
FIG. 6 is a partial bottom view of the quick release modular backpack system of FIG. 1, in enlarged scale.

Exemplary Carrier:

Referring now to FIGS. 1-2, and 4-7, an exemplary carrier 34 or auxiliary load module provides a versatile structure with an auxiliary load attachment surface for adding one or more releasable storage components. The carrier includes a main frame 146 with a front interior, chassis facing, surface 148 and a rear outwardly facing surface 150. Projecting from the main frame is a left sidewall 152, a right sidewall 154, a top wall 156, and a bottom wall 158. The walls of the carrier cooperate to space the front surface 148 of the main frame 146 of the carrier 34 away from the rear surface 50 of the chassis 32 and cover the channel 94 to form a convenient storage and retention compartment 160 when the two components 32, 34 are engaged as shown in FIG. 6 for example. Throughout the main frame 146 is a set of strap receiving slots, with an exemplary slot designated 162, for receiving the straps of a backpack, generally designated 164 (FIGS. 16A-17D), that may be attached to the carrier as described below. The sidewalls also include a set of strap receiving slots, with an exemplary sidewall slot designated 166, for receiving a portion of one or more straps releasably securing the backpack 164 to the carrier.

Figure 7:
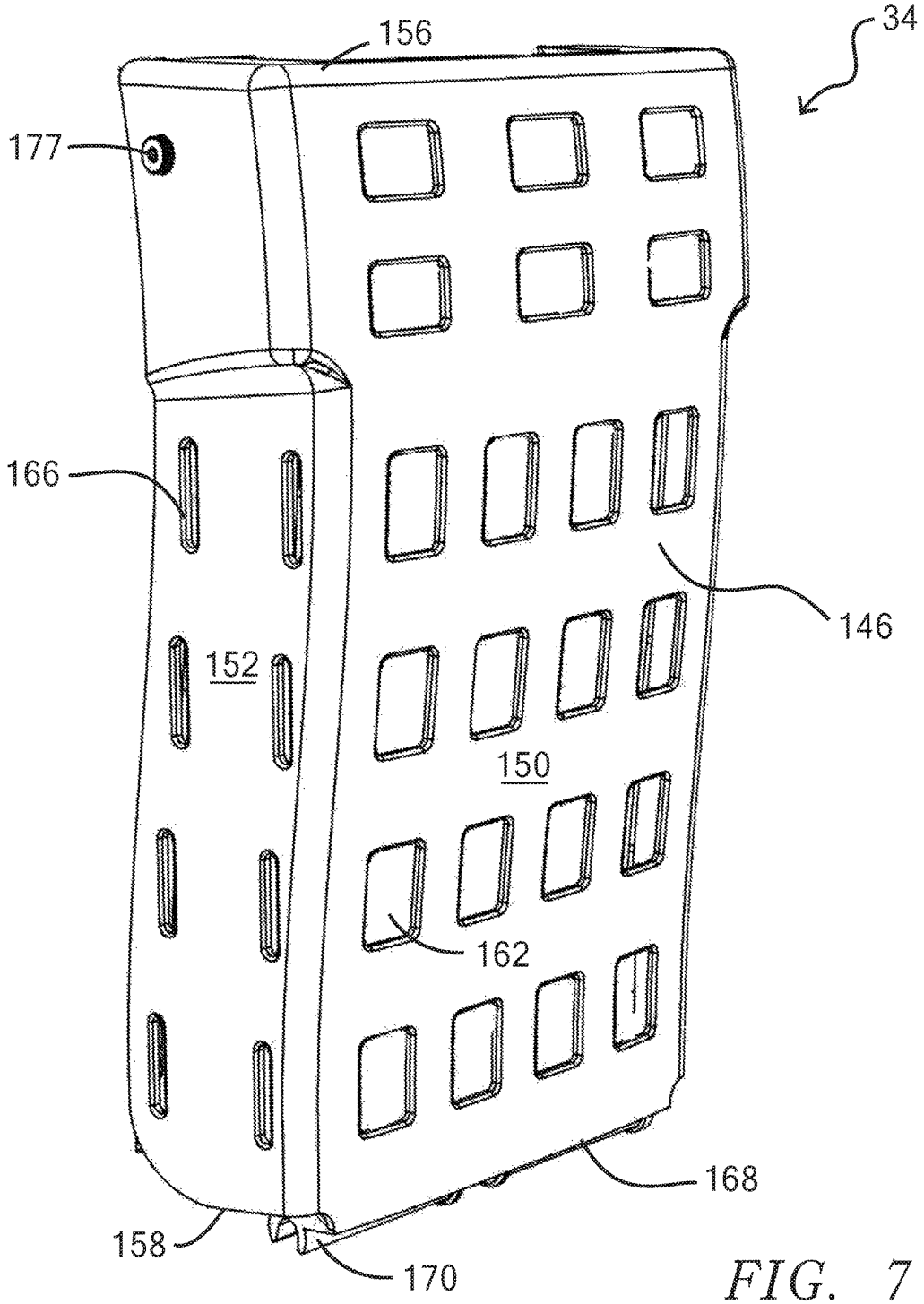
FIG. 7 is a similar view as in FIG. 1 with the chassis (primary or essential load support) removed leaving only the carrier (auxiliary load support).

Referring now to FIGS. 6-7, the bottom wall 158 of the carrier 34 includes a partially open left claw 168 and a partially open right claw 170 (or open talon-like structure) for placement atop the corresponding left side pivot point 100*a* and the right side pivot point 100*b*. The open claw structure allows a user to place the carrier onto the pivot point of the chassis 32 where the carrier may rotate relative to the chassis and also fall completely away or be shed from the chassis as described in more detail below.

Figure 17A:
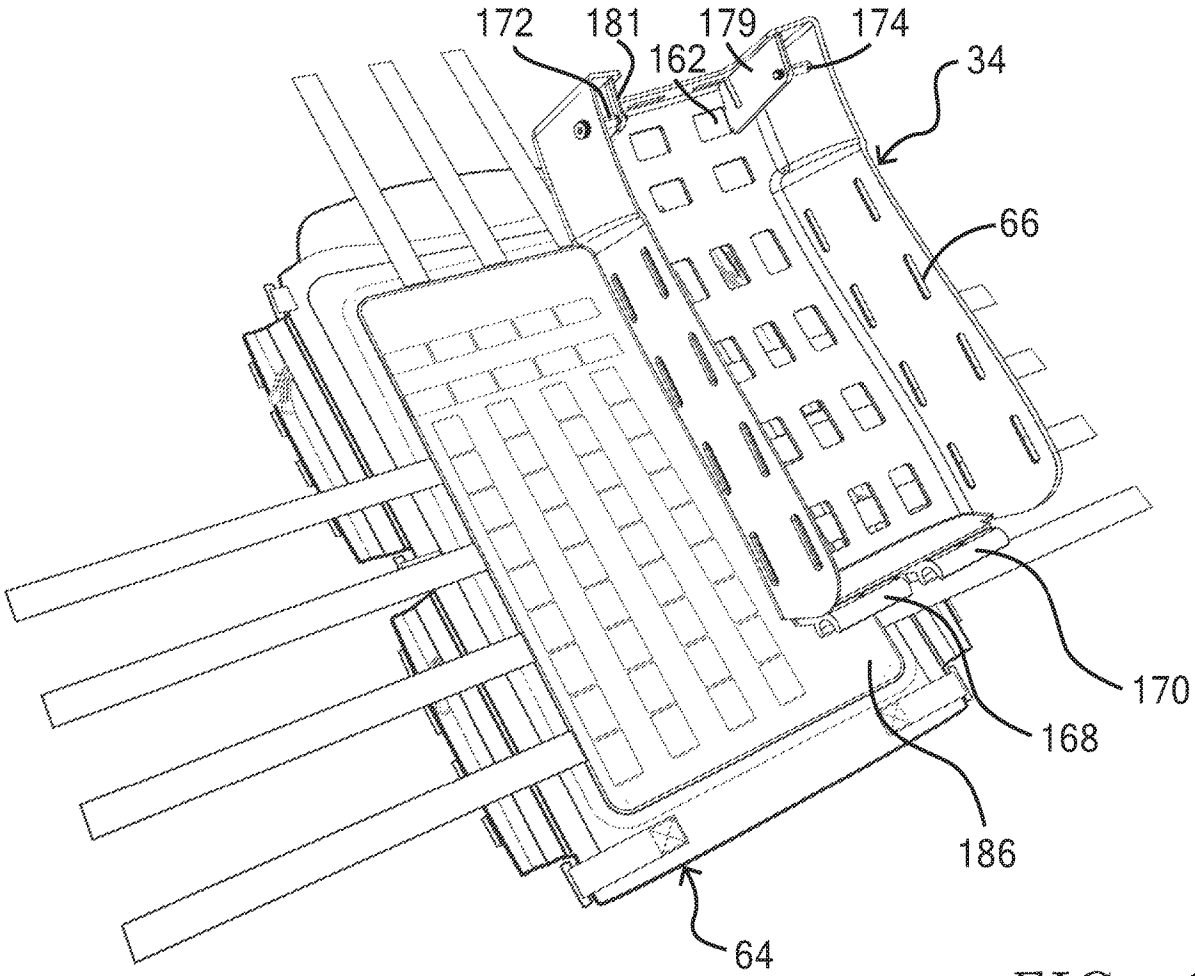
FIGS. 17A-D depict front perspective views of the various stages of releasably assembling an exemplary pack on the auxiliary load bearing support (carrier).
Figure 17B:
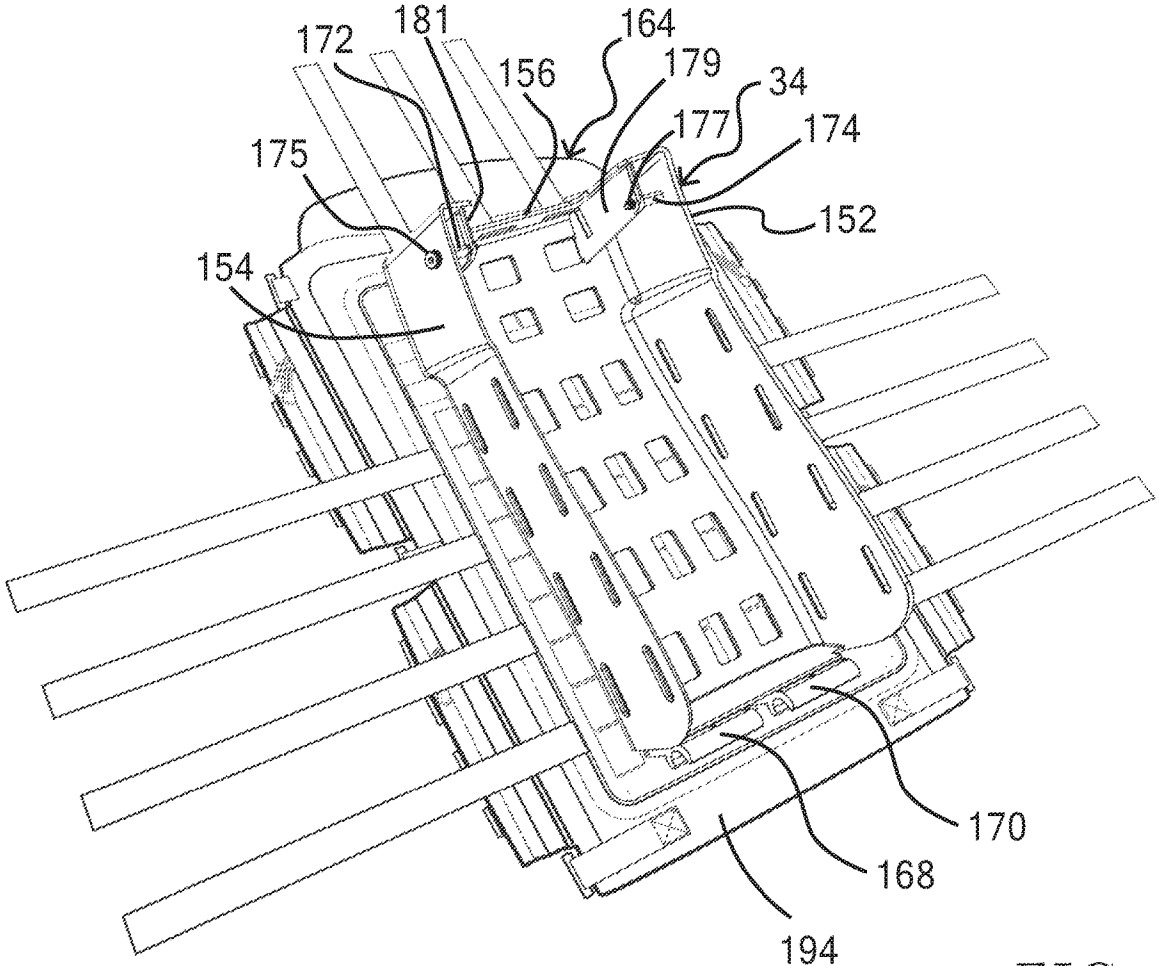

Referring now to FIGS. 17A-D, the upper end of the carrier 34 includes a left capture bar 172 and an opposing right capture bar 174 spaced apart to coincide with corresponding hooks 120*a*, 120*b* of the left and right catches 106 and 108 secured to the chassis 32. The capture bars are secured to the carrier using a bolt 175, 177, respectively, passing through each capture bar and anchored at each end to the sidewall 152, 154 and an inner wall 179, 181 of the carrier (FIGS. 17A-17B). Each capture bar is constructed to releasably retain the carrier on the chassis when the hooks are engaged in a capturing position as shown in FIG. 12 for example. Preferably, the capture bars are round to facilitate a sliding motion relative to the hooks to assist in shedding the carrier from the chassis.

Figure 16A:
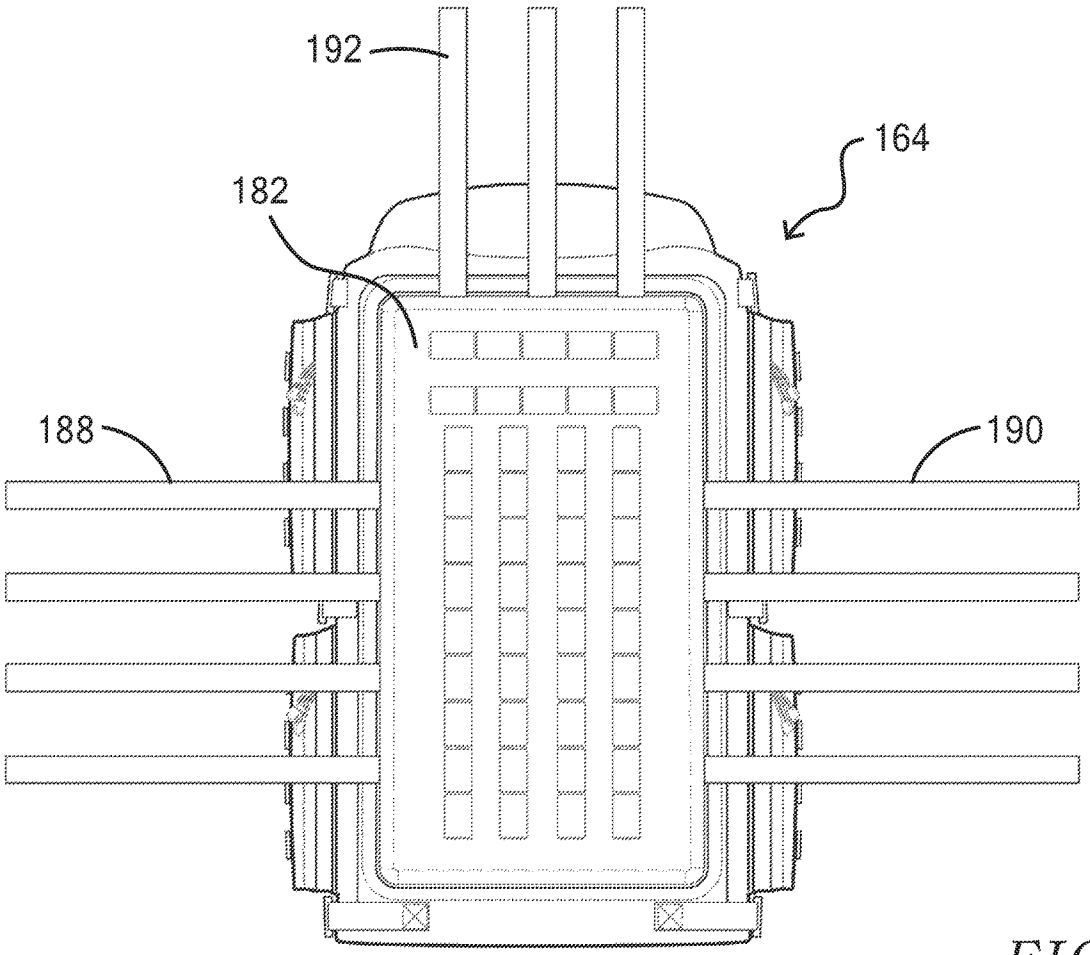
FIGS. 16A-C depict front (FIG. 16A), rear (FIG. 16B), and right side (FIG. 16C) views of an exemplary pack that may be used with the quick release modular backpack system of FIG. 1.
Figure 16C:
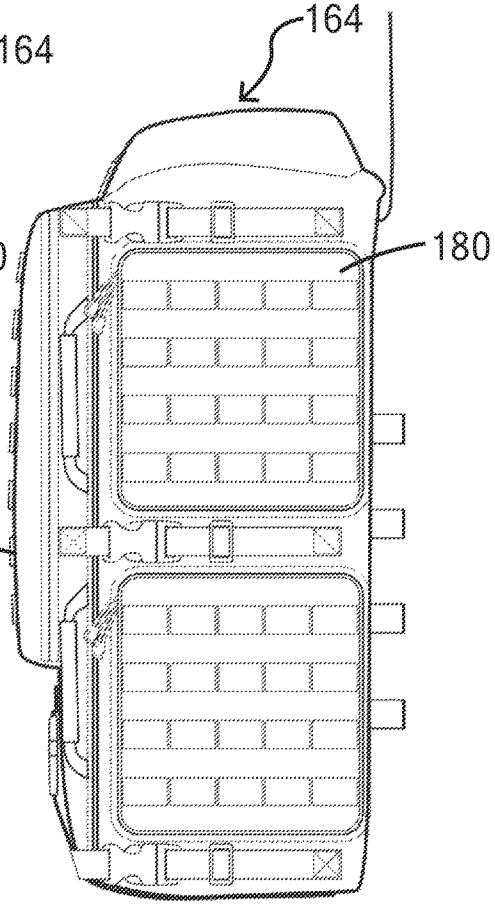
Figure 16B:
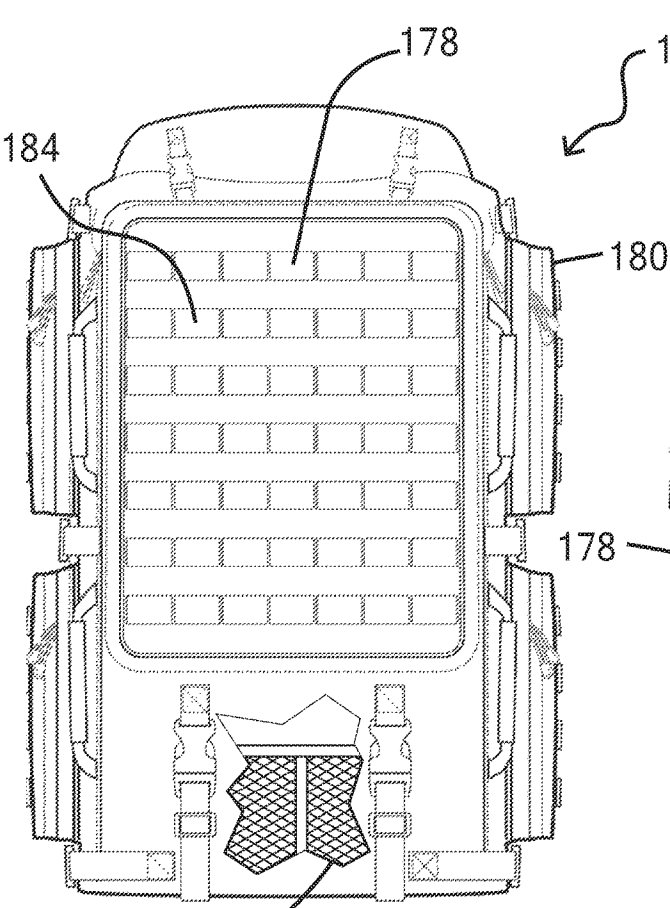

Carrier Pack:

Referring now to FIGS. 16A-C, the carrier 34 may support a pack 164 that defines at least one interior compartment 176 (FIG. 16B) and an outer surface 178 allowing for attachment of one or more organizational pouches, a representative example being designated 180. The pack includes a set of left, right, and top retention straps 188, 190, 192, respectively, for weaving into the slots such as slots 162, 166 of the carrier 34. This weave is quite sturdy and it is difficult to shed the pack from the carrier once the weave is set. In addition, the outer surface 178 of the pack 164 includes webbing 184 for receipt of the individual pouches, containers, or other items to be carried, such as pouch 180.

The front surface 182 of the pack is recessed or stretchable to closely conform to the outer surface 150, 152, 154 of the carrier when secured thereto. It will be appreciated that one of ordinary skill familiar with the PALS would understand the webbing and attachment process.

Materials:

The chassis 32 and carrier 34 may be constructed of a rigid plastic or glass-filled nylon and constructed using injection molding techniques. Other suitable materials and construction techniques may be used as well, including, for example, ABS-PC. In military or other combat related settings, the chassis and carrier may also be sprayed with additional ballistic protection to raise the category of protection by at least one rating. The straps are typically constructed of a woven fiber or nylon. The cable may be constructed of metal. The pack and pouches are constructed of canvas, nylon, or other suitable material. These materials are not meant to be limiting and other suitable materials including lighter and stronger materials may be preferable as that technology arises.

Exemplary Assembly of a QRMBS:

To assemble the QRMBS 30, referring to FIGS. 1, 3, 7, and 8, the chassis 32 may be placed with the front surface 48 on a flat support surface leaving the rear surface 50 exposed. Then, with the interior surface 148 of the carrier 34 facing the rear surface 50 of the chassis 32, the claws 168, 170 are placed atop and seated against their corresponding pivot points 100*a*, 100*b*. The carrier is then rotated about the pivot points 100*a*, 100*b* until the capture bars 172, 174 are pushed into their corresponding catches 106, 108 and between the inner tooth 122*a* and outer tooth 124*a* of each hook element 120*a*, 120*b*. Pushing the top wall 156 of the carrier further into the catches 106, 108 will result in audible click once the hook elements rotate sufficiently to engage the detent 130*a*, 130*b* in each release bar 128*a*, 128*b* thereby releasably locking the top end of the carrier to the top end of the chassis. In this configuration as shown in FIGS. 1-6 and 12-13, the chassis and carrier come together like a clamshell and define the interior compartment 160 wherein essential equipment may be stored. Then, the chassis 32 with attached carrier 34 may be donned by slipping the user's arms through the shoulder straps 40, 42 (FIG. 15) to locate the front surface 48 of the chassis 32 against the user's back. It will be appreciated that the carrier may also be attached to the chassis while the chassis is already donned by the user.

Figure 17C:
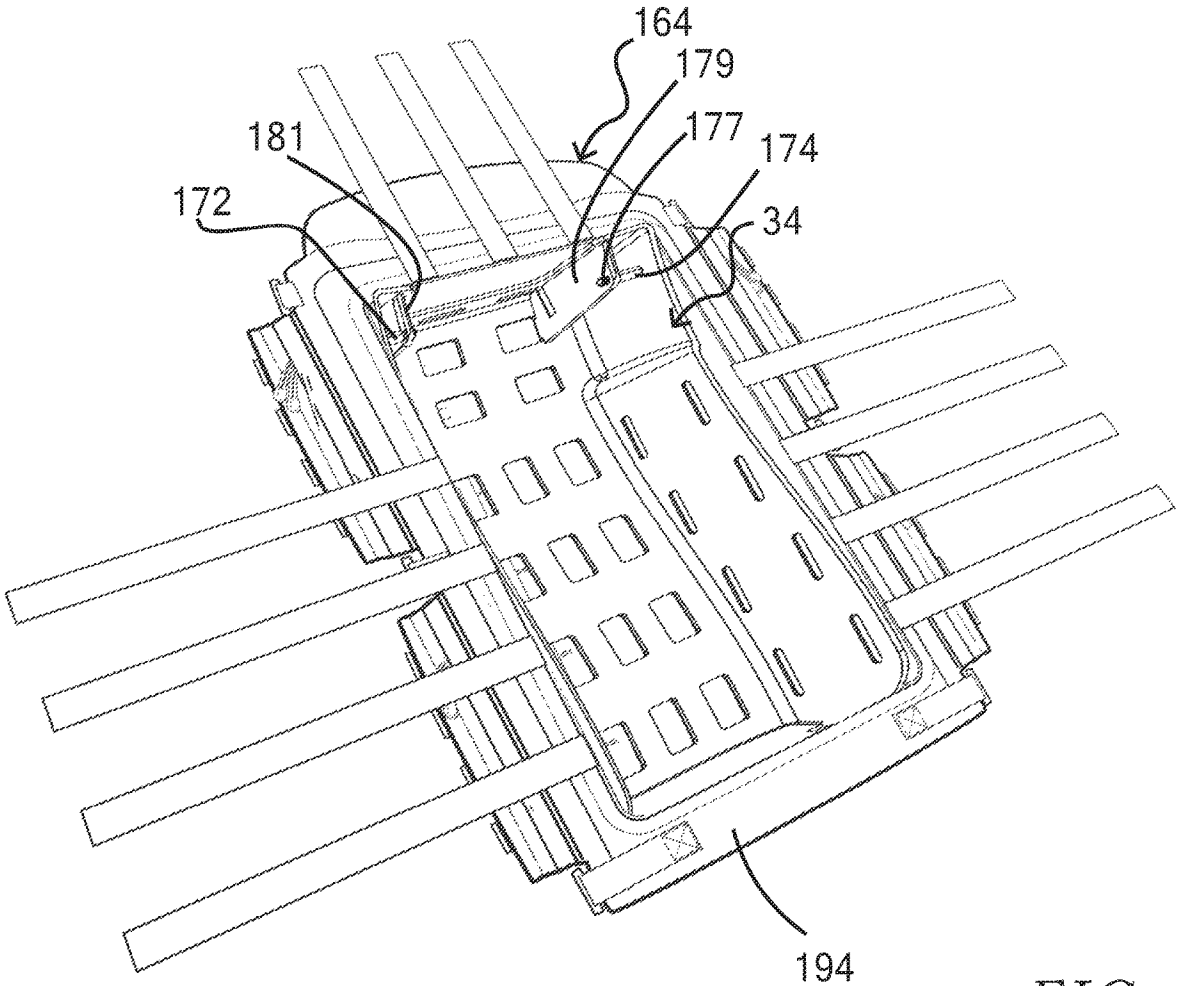
Figure 17D:
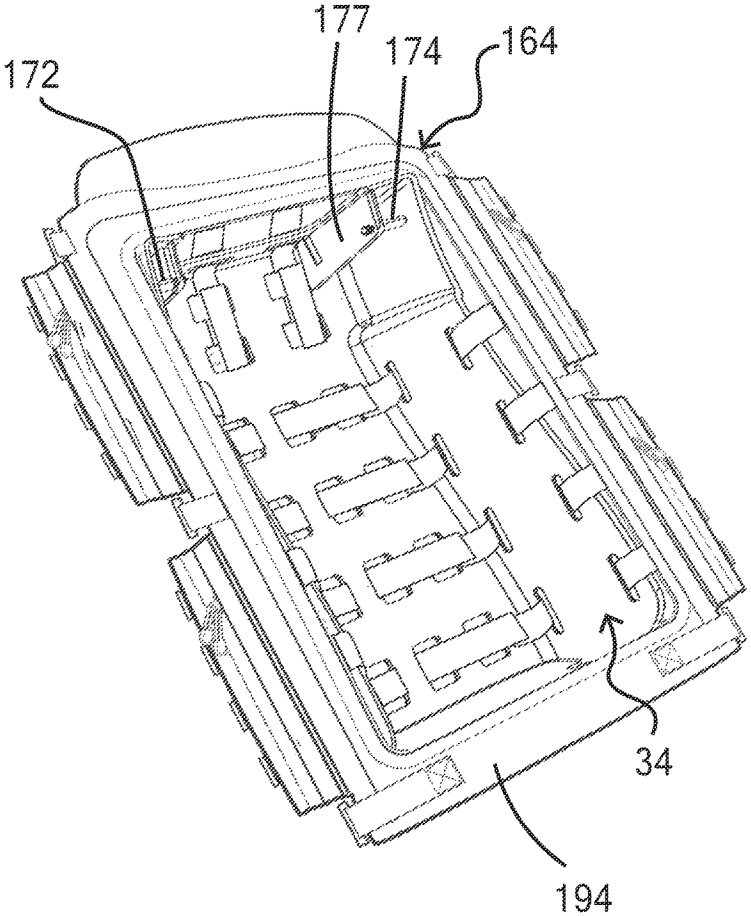

In addition, FIGS. 17A-D show various stages of attaching the pack 164 to the carrier 34 starting with nesting the carrier in a flat recessed surface 182 of the pack that includes strap extensions 188, 190, 192. The strap extensions are then woven through the slots such as slot groupings 162, 166 in the carrier 34 as would be familiar to anyone with the PALS. In FIGS. 17A-17B, the carrier 34 is placed with the rear surface 150 against the front surface 182 of the pack and aligned accordingly. With the carrier 34 nested against the pack 164 as shown in FIG. 17C, the left side pack straps 188, right side pack straps 190, and top pack straps 192 may be woven through the slots 162, 166 in the carrier as would be understood by one of ordinary skill in the art resulting in a pack 164 secured to the carrier 34 as shown in FIG. 17D. The claws 168, 170 are not shown in FIGS. 17C-17D as the claws are concealed by a bottom panel 194 of the pack 164 but are exposed behind the panel to be placed on the pivot points 100*a*, 100*b* as discussed above. The bottom panel 194 helps to seat and support the bottom edge 158 of the carrier.

Figure 1:
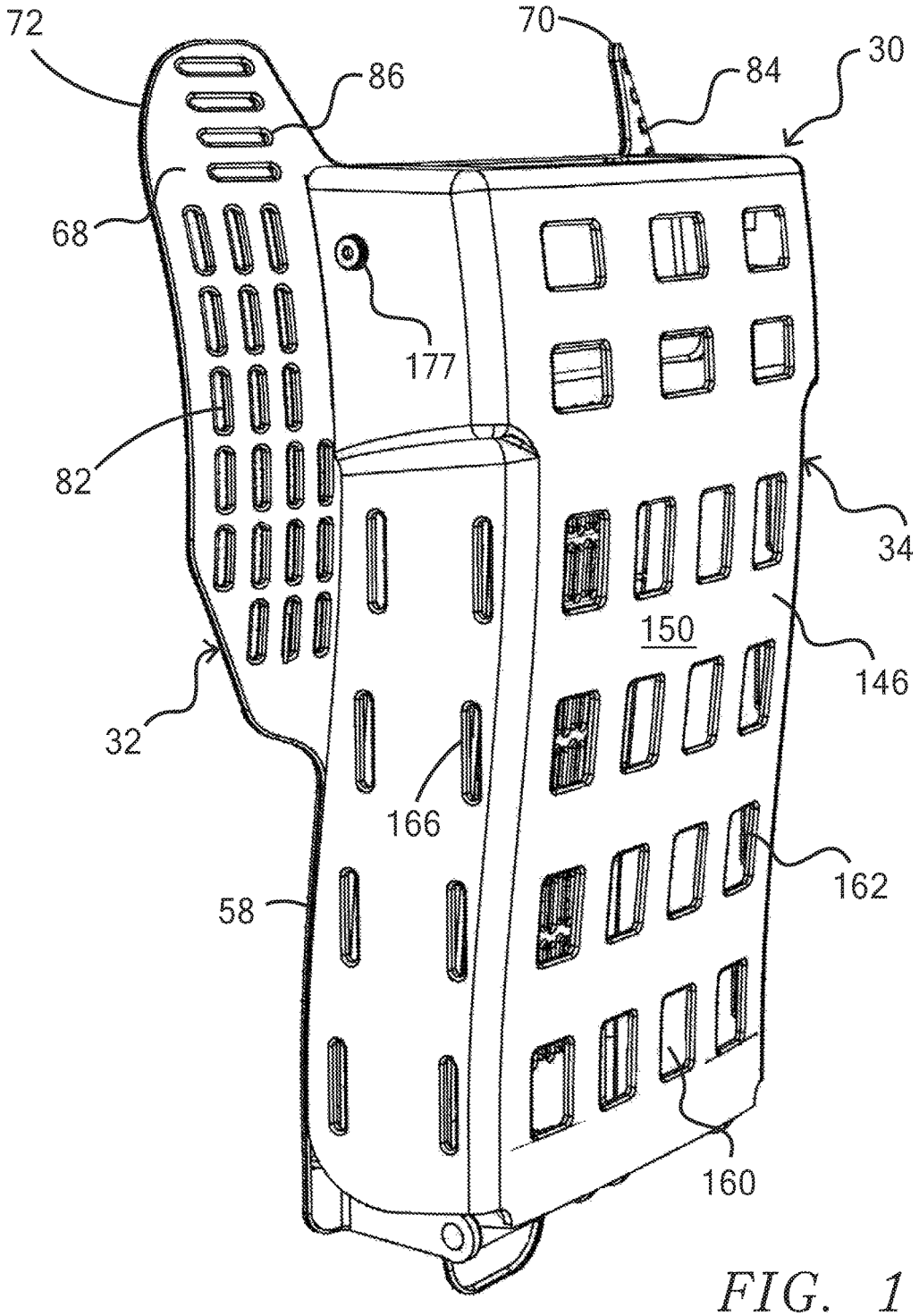
FIG. 1 is a perspective view of an exemplary embodiment of a quick release modular backpack system (QRMBS) in a closed configuration without the shoulder straps or other attachments constructed in accordance with the principles of the present invention.
Figure 14:
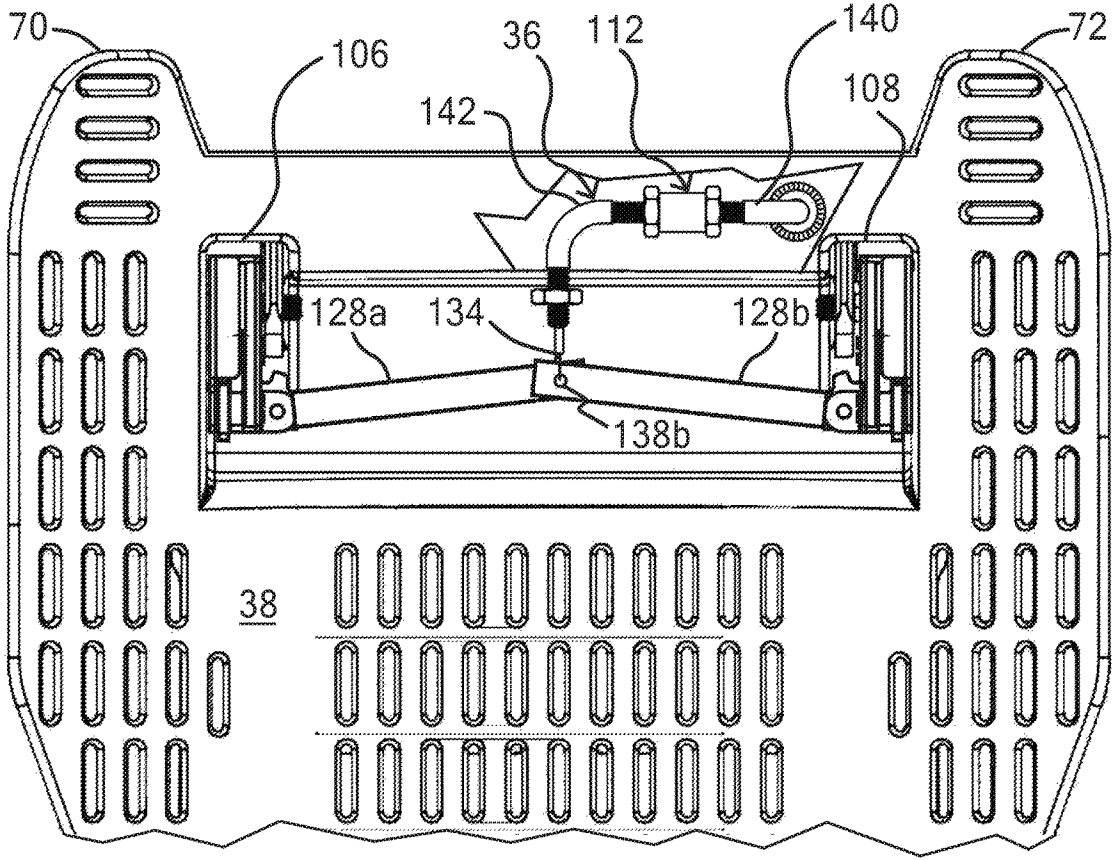
FIG. 14 is the same view as FIG. 13 with the quick release mechanism at least partially actuated into an open, release, or ready to receive configuration.
Figure 18A:
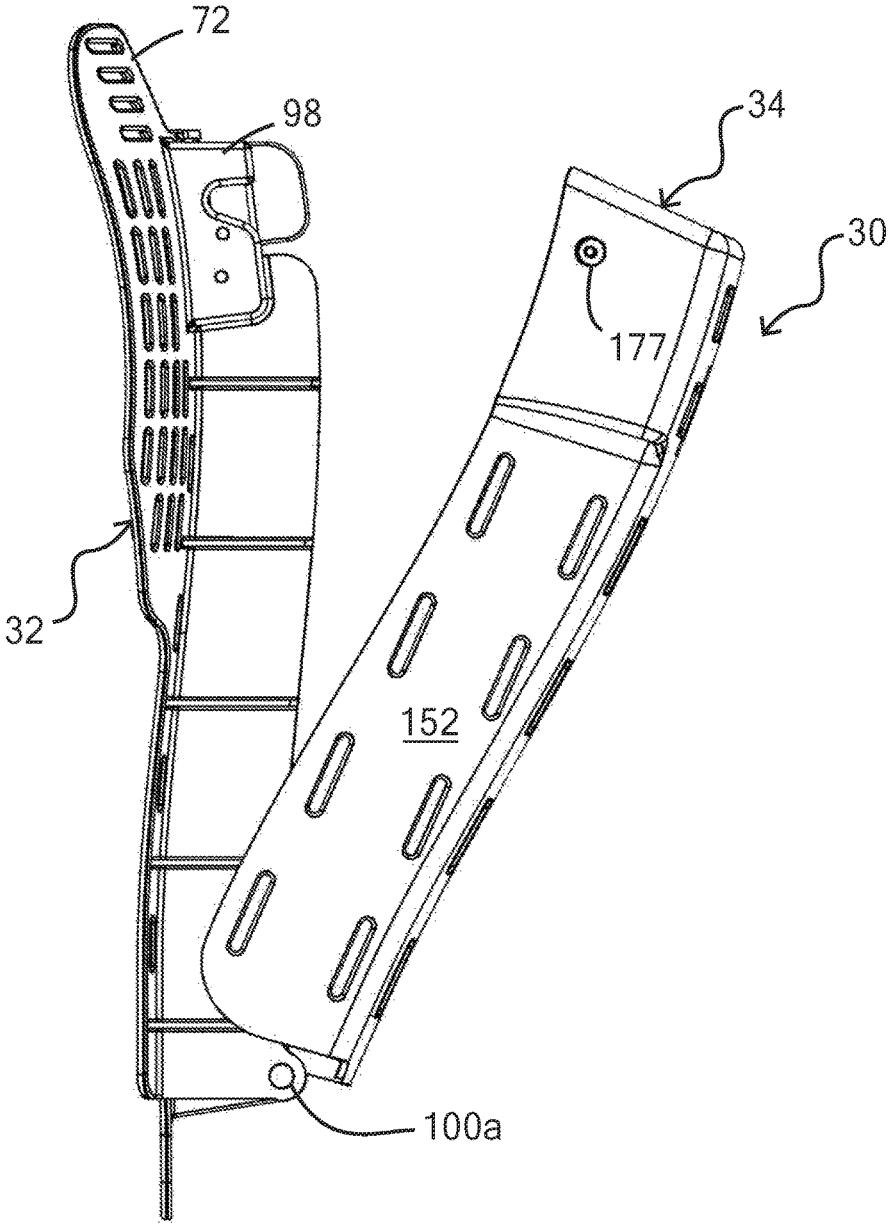
FIGS. 18A-D depict the quick release modular backpack system in various stages of shedding the auxiliary load support from the primary load support that would start at FIG. 4 (captured) through after release (FIG. 18A) rotating away from the primary load support at a first intermediate position, later in time (FIG. 18B) at a second intermediate position, later in time at a third intermediate position (FIG. 18C), and finally with the auxiliary load support (module) completely shed from the primary load support (FIG. 18D).
Figure 18B:
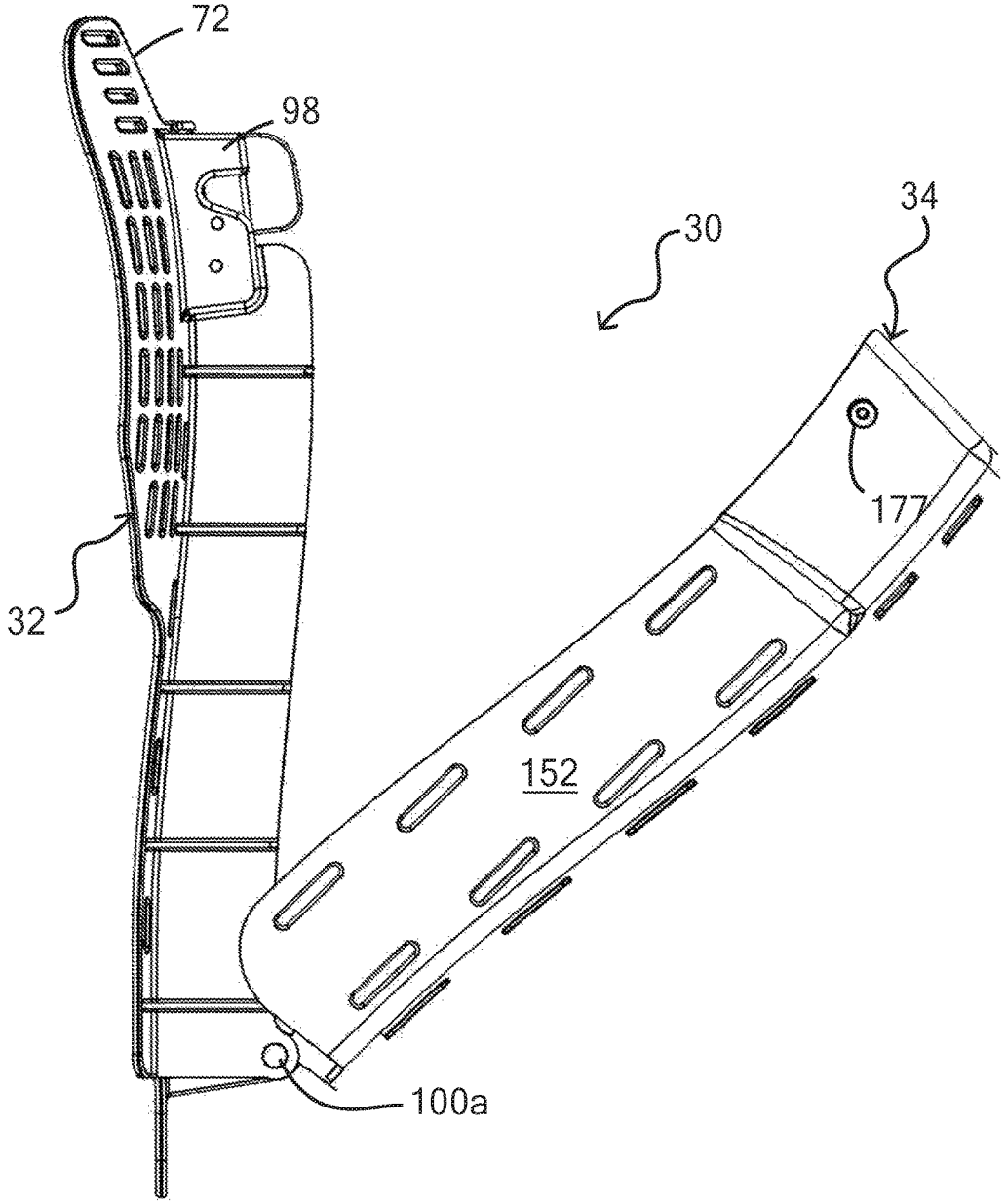
Figure 18C:
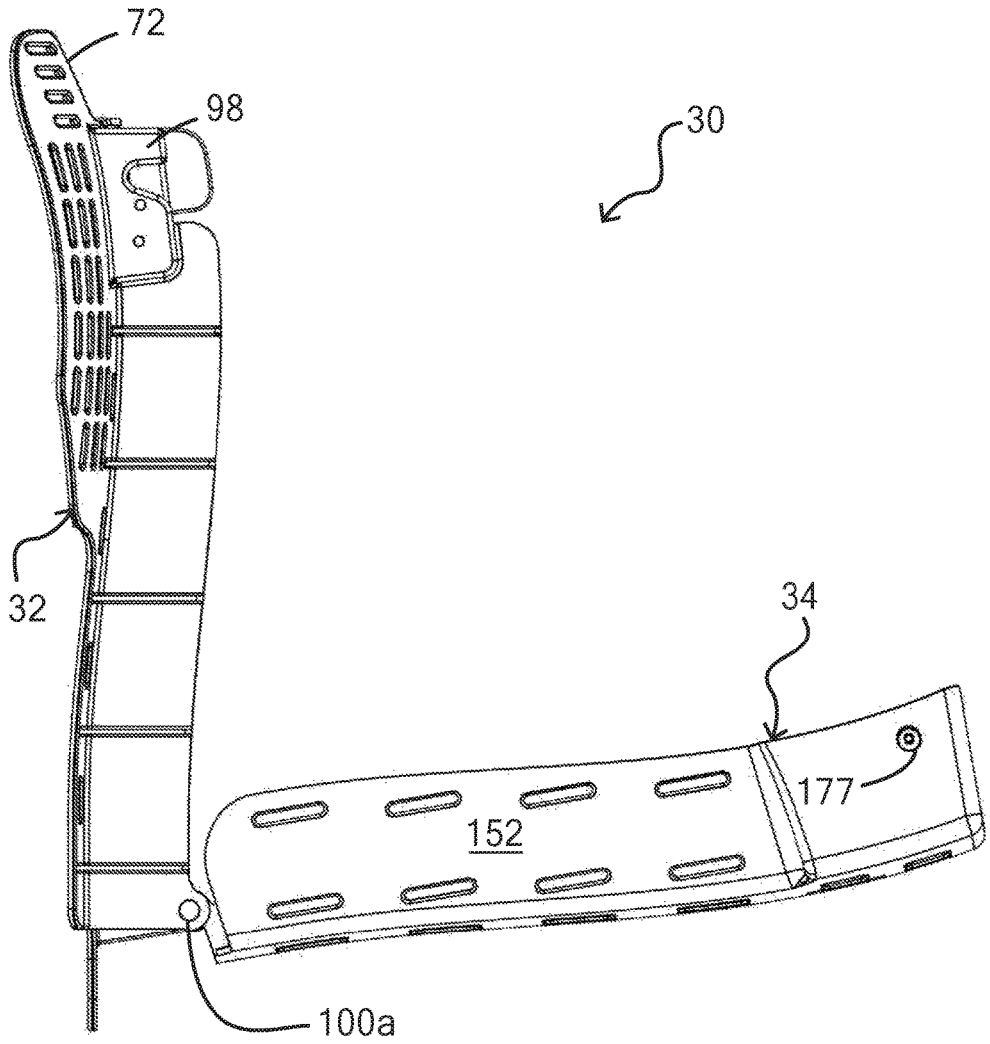
Figure 18D:
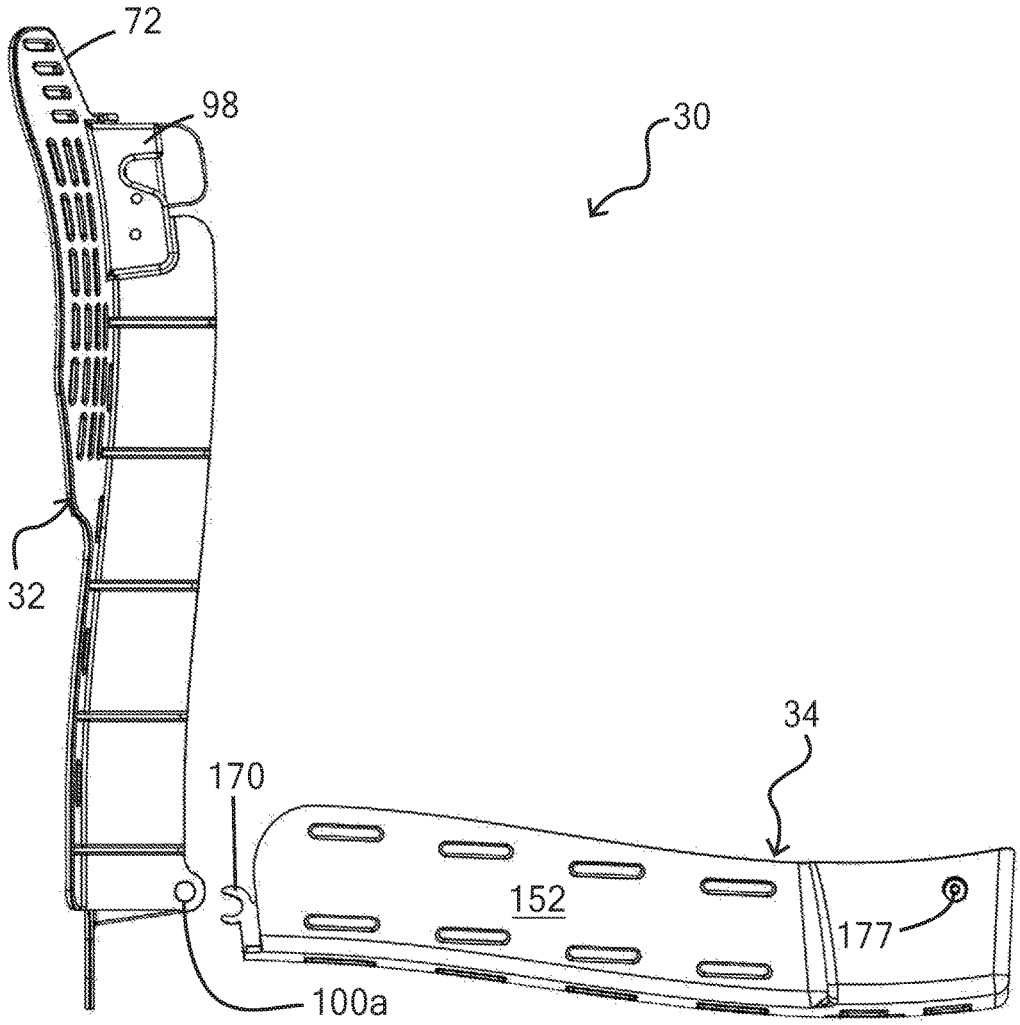

Exemplary Use of a QRMBS:

Referring now to FIGS. 1, 11-15, and 18A-19C, a process for selectively shedding or divesting the auxiliary load module (carrier) 34 from the primary or essential load support 32 (chassis) will now be described. As shown in FIG. 1, the carrier is releasably engaged with the chassis. To selectively shed the carrier from the chassis, the user may simply pull on the handle 136 on the actuator easily accessible on a shoulder strap, 40 or 42. More specifically, when the actuator handle 136 (FIG. 15) is pulled, the cable 134 draws the inner ends of the release bars 128*a* and 128*b* up toward the top 52 of the chassis 32 due to the rigidity in the fixed sleeve 140, 142. This motion changes the position of the respective detents 130*a*, 130*b* in each release mechanism 106, 108 allowing the hooks 120*a*, 120*b* to rotate from a capturing position (FIGS. 12-13) to a release position (FIGS. 11 and 14). Thus, with a single motion on the handle 136, the user may release anything captured by the dual catch configuration. In this exemplary embodiment, the single motion is a pulling motion. The various stages of release are shown in FIGS. 1 and 18A-D. In FIG. 1, the carrier 34 is fully engaged with the chassis. In FIG. 18A, the handle 136 has been pulled by the user releasing the capture bars 172, 174 from the corresponding catches 106, 108 due to the cable 134 lifting the inner ends of the release bars 128*a*, 128*b* to rotate the detent 130*a*, 130*b* to free the hooks 120*a*, 120*b* to rotate allowing the capture bars to disengage from the catches 106, 108. Under gravity, the upper end of the carrier 34 begins to rotate away from the chassis 32 while the claws 168, 170 pivot around the pivot points 100*a*, 100*b*. This process continues through FIGS. 18B-D until the entire carrier 34 and any anything attached to the carrier fall completely off the chassis as in FIG. 18B as the open claws release from the pivot points.

Figure 19A:
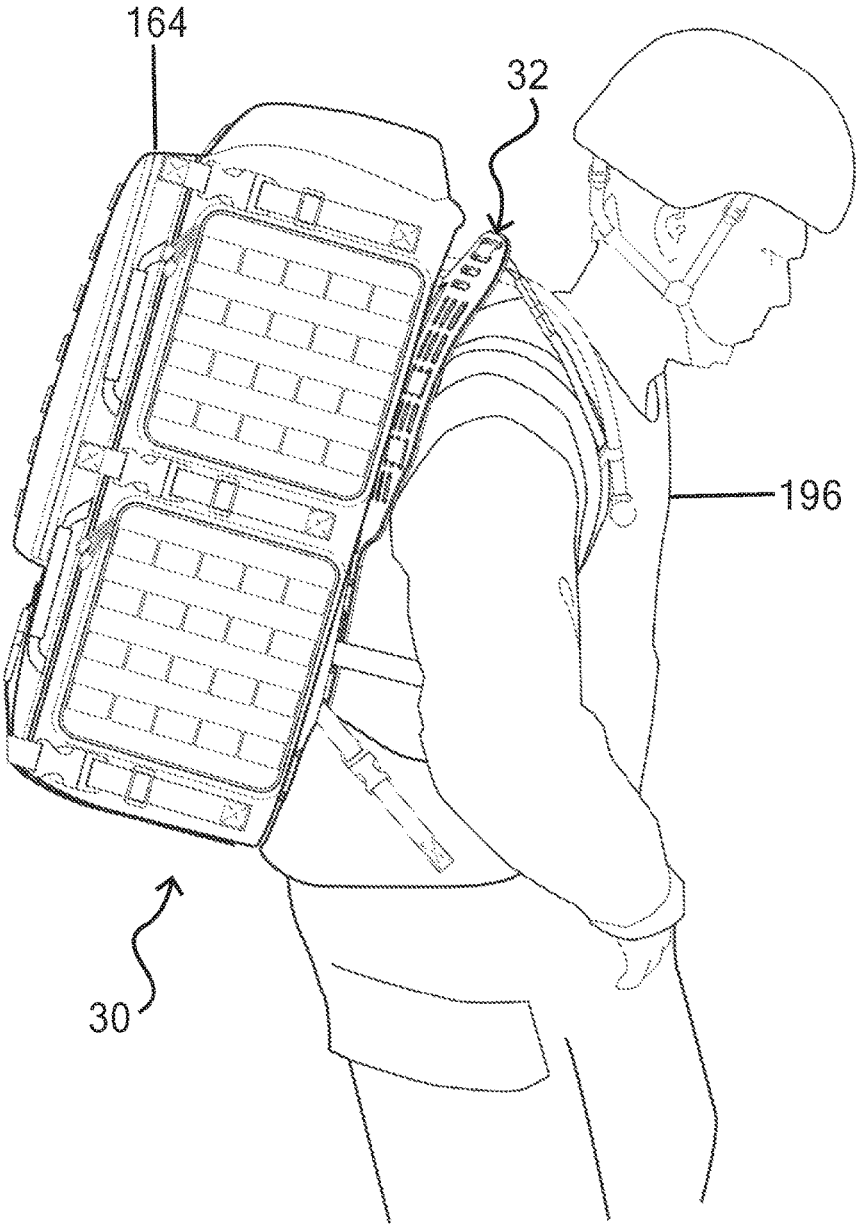
FIGS. 19A-C depict similar load shedding events as in FIGS. 18A-D but further illustrating the assembled quick release modular backpack (FIG. 19A), followed by the initial shedding of the auxiliary load support (FIG. 19B), followed by the complete shedding of the auxiliary load support from the primary load support (FIG. 19C) worn by a representative soldier.
Figure 19B:
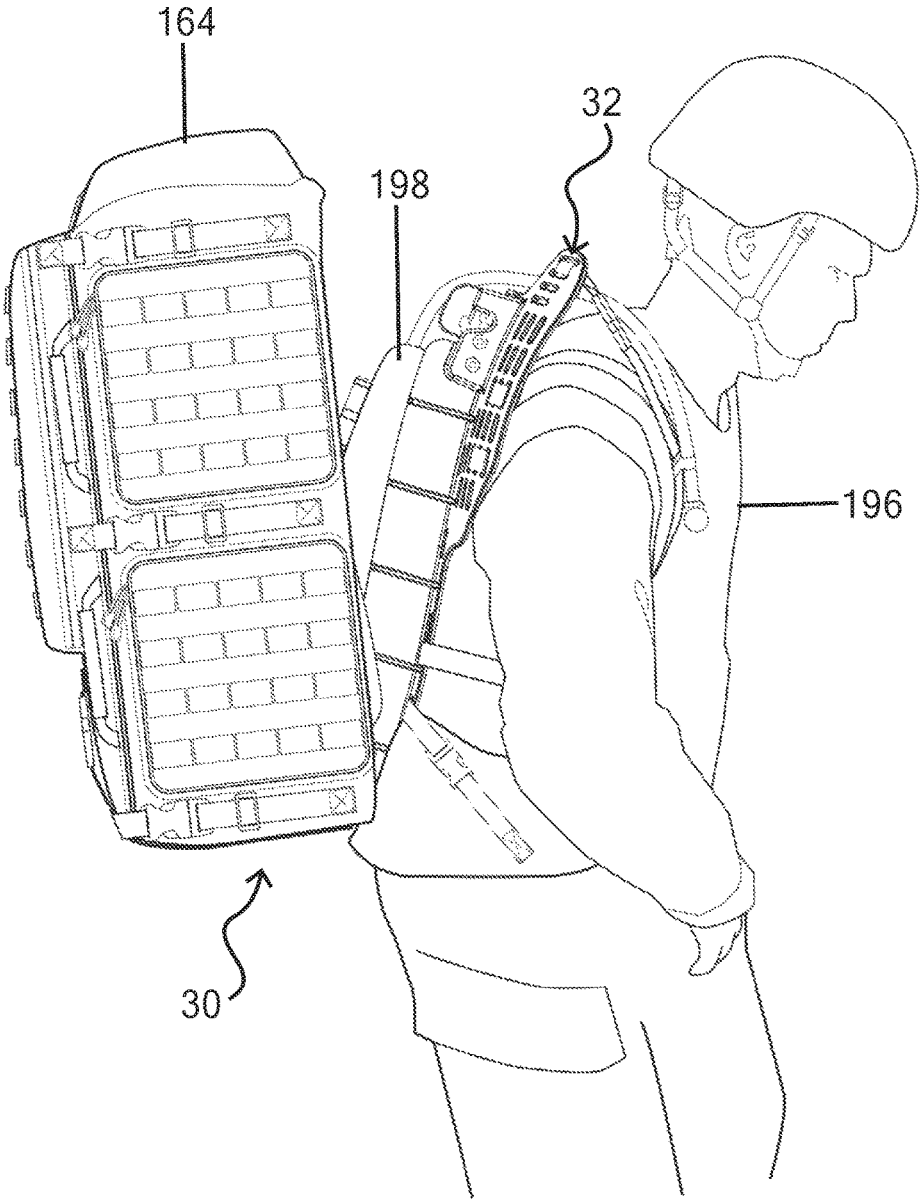
Figure 19C:
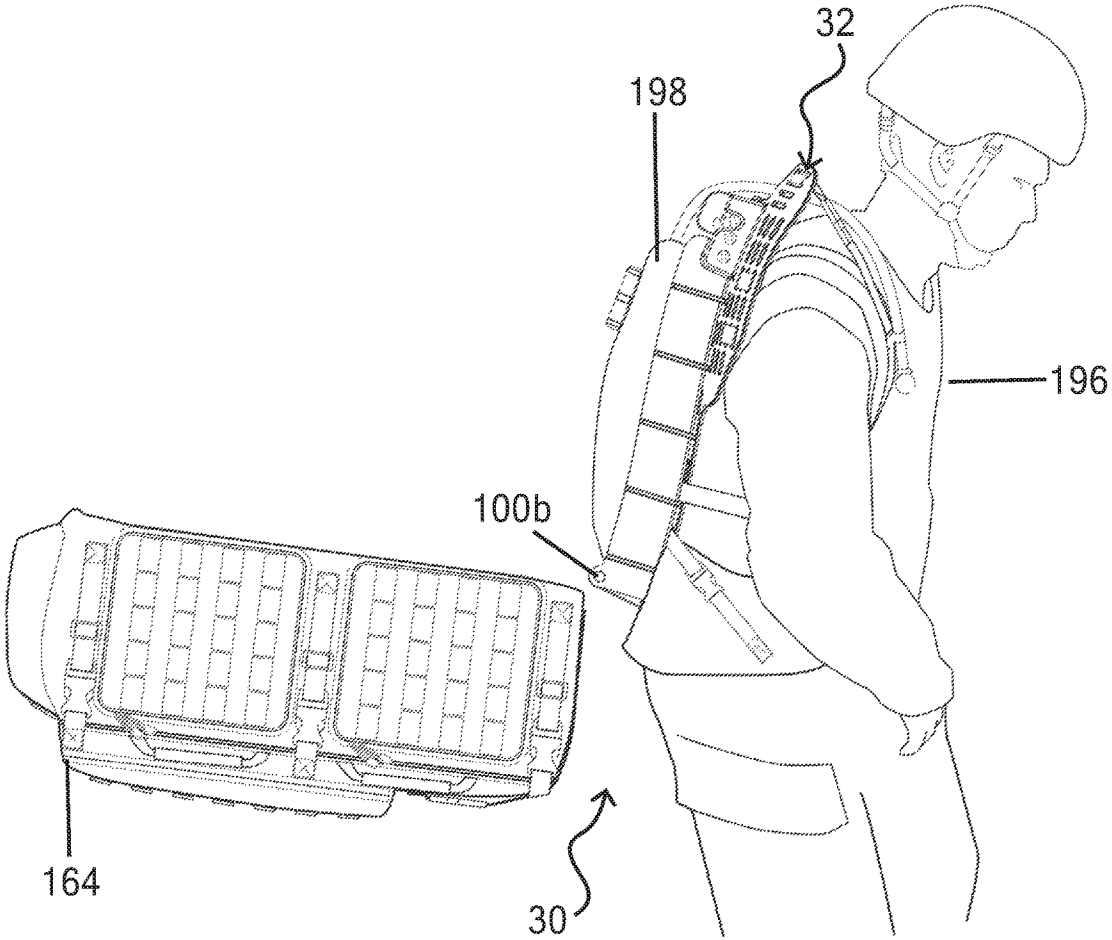

The process is also shown in FIG. 15 and FIGS. 19A-C depicting a soldier 196 wearing a QRMBS 30 with a pack 164 attached to the carrier 34. In FIG. 19A, the soldier is wearing a fully assembled QRMBS 30 including the pack 164. As the handle 136 (FIG. 15) is pulled, the carrier 34 and pack 164 begin to fall away from the chassis 32 (FIG. 19B). Finally, as shown in FIG. 19C, the carrier and pack fall completely away from the chassis landing somewhere behind the soldier's feet. In this example, the chassis 32 remains on the soldier's back as does a hydration bladder 198 secured to the chassis, which is often an essential component of a fighting and survival load.

In addition, the carrier 34 may be removed when in a prone position. For example, the wearer may pull the cable handle 136 and roll to one side to discard the carrier from the chassis 32. The carrier may then provide some additional protection for the prone user.

Racking System:

It will be appreciated that the snap in construction of the carrier 34 allows the carrier to be releasably connected to a rack system so that multiple carriers, loaded or unloaded, may be organized on a rack or racks having a similar quick release retention system as the chassis. Thus, before going out in the field, different carriers may be organized for different scenarios. When the user arrives at the scene and analyzes his or her needs, a carrier with the appropriate articles may be selected and simply snapped onto the user's chassis. The rack may be mounted at a station or in a land, air, or water transport vehicle.

Figure 20:
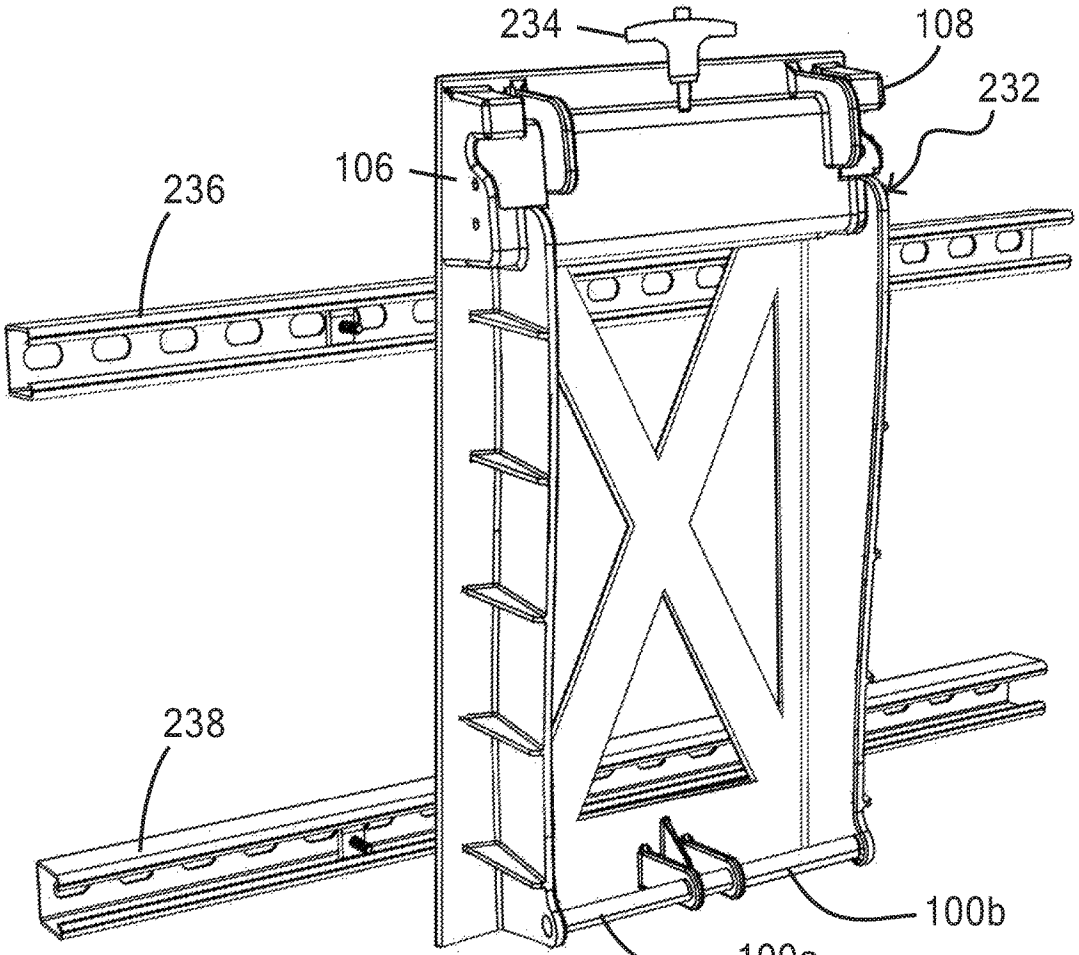
FIG. 20 is a rear perspective view of an exemplary rack system for use with the quick release modular backpack system of FIGS. 1-19C.

Referring now to FIG. 20, an exemplary rack system will now be described. As shown in FIG. 20, a storage chassis, generally designated 232, is constructed similarly to a wearable chassis 32 discussed above and is usable with any of the carriers 34 discussed above. However, the storage chassis includes a release handle 234 in lieu of or as an alternative quick release mechanism for releasing the carrier 34 (FIG.

7) from the storage chassis. The quick release handle is useful when space is at a premium and provides an alternative release means as the shoulder straps and pull cable are not needed since the storage chassis is secured to a support surface. In this example, the storage chassis is shown connected to a fixed surface using a set of spaced apart upper and lower rails 236 and 238, respectively. The rails may be fixed to a wall or the interior or exterior of a vehicle surface using conventional fastening technology. The storage chassis is then releasably or fixedly secured to the rails with a fastener or locking mechanism. The connection of the storage chassis to the rails may allow for adjustment along the length of the rails. For example, the storage chassis may be slid along the length of the rails and repositioned. Attachment and removal of a carrier is the same as for the storage carrier in FIG. 20.

In use, a carrier may be placed on the pivot bar 100*a*, 100*b* at the bottom of the storage chassis 232 and rotated until locked into place by the quick release catches 106, 108. To release the carrier from the storage chassis, the user may simply pull the release handle 234 upwardly to disengage the quick release catches similar to the wearable chassis quick release mechanism described above and then lift the carrier off the storage chassis. While the QRMBS is primarily useful for donning by a user, the support surface described herein may include a user's torso or a fixed support surface such as a wall or interior/exterior of a vehicle.

Other Alternative Embodiments, Modifications, and Appreciations:

While the embodiments described herein have recreational, first responder, and military applications, the quick shedding feature is especially critical in military settings or other settings wherein a load must be shed quickly while retaining essential items. A variation may be used on police and military pets as well, although a handler would need to assist in the quick removal of the auxiliary load.

It will be appreciated that the embodiments above describe a release mechanism with two spaced apart capture hooks positioned near the top of the chassis. The capture hooks are both connected to a single cable that, when pulled, releases the claws to release the carrier. A single claw may be used or each claw may have a dedicated actuator cable. A push button, twist knob, or other suitable actuator may be used in place of a cable. Instead of claws or hooks, catches, clips, pins, slides, hinges, magnets, buttons, zippers, snaps, hook and loop, and other suitable quick release fasteners may be used.

In addition, the embodiments described above are directed to single motion actuators as this is preferable to support a quick release system. However, a safety catch or cover to be removed prior to the single motion or a multi-motion actuator would fall within the scope of the present invention as well. In addition to a pulling motion, other motions including pushing, pressing, depressing, twisting, screwing, sliding, clicking, squeezing, blowing, stretching, and transmitting may be used.

In general, the actuator is in communication with the catches. This communication may be direct or indirect with components provided in between. A wired or wireless communication may also be used. For example, the catches may include electronic components that may be actuated with the push of a remote button or other wireless signal to release the catches when engaged.

While the embodiment above describes the release mechanism on the chassis and the coupling bar on the carrier, these positions may be reversed. In addition, the chassis and carrier assembly may be constructed to pivot upwardly like a hatchback. The release mechanisms may be located anywhere on the chassis and carrier bodies including at the extreme outermost edges and anywhere in between.

In practical use, it will be appreciate that the Quick Release Modular Backpack System provides at least one or more of the following advantages over conventional modular packs: variable volume carriers, rapid release of the entire carrier and associated pouches and articles stored therein, retention of the chassis and attached essential articles including such items as a water bladder, easy "hot" swapping of similarly or variably packed carriers, rack mounting organization, one person release actuation, easy to release in a prone position, releasable carrier with rifle maintained in firing position, easy to reconnect carrier to chassis, ballistic sprayable surfaces, usable with PALS, wearable over bullet proof vest, and a rigid load bearing system.

The problem of shedding a portion of a large capacity backpack system while retaining one or more essential components is provided by a chassis coupled to a carrier by a quick release system wherein the carrier may be shed by the user by simply actuating the quick release system while the chassis remains and retains one or more essential components.

The problem of hot swapping out a portion of a large capacity backpack system is provided by a chassis coupled to a carrier by a quick release mechanism that may be actuated to releasably couple the carrier to the chassis.

The embodiments discussed herein solve many of the drawbacks of earlier solutions by providing such a QRMBS. The quick release system was primarily designed in response to concerns that it was difficult for any personnel to remove backpack when encountering danger. The optimal response to gunshot is 1.5 seconds or less. Unfortunately, removing a traditional backpack takes much longer than 1.5 seconds. Fortunately, the QRMBS was designed specifically to remove the carrier (auxiliary load module) within 1.5 seconds and replace the carrier within the similar time frame using just a single motion and either hand. Other backpacks take much longer to remove and put back to continue mission or activities.

The QRMBS also allows for quick release of the carrier and associated backpack while maintaining all necessary gear. In other words, the carrier with its heavy load fall away while the chassis stays on the body retaining essentials such as the MTV, ammunition, communication gear and especially water as stored in an attached hydration bladder. The importance of hydration can't be overstated as the area of conflict, hiking trails or mountains ranges can cause severe hydration.

The present invention also allows for quick change of alternative carriers packed to fill specific needs or support particular missions. The allowance of quick attachment gives this invention the advantage of changing out the carrier as needed quickly and easily as mission or terrain changes.

The QRMBS also includes an innovative backpack 164 (the soft good). The large main compartment alone is constructed to hold approximately 3,000 cubic inches of gear. The double zipper front pocket is about 11"×6"×3". The large main section is about 18"×20"×9". The sleep carrier part has enough room for a huge sleeping bag or a two-man tent and smaller sleeping bag, and the entire pack has a 100 lb. load capacity. The 3,000 cubic inch-capacity backpack offers a better option for missions that don't require the full 5,000 cubic inch-capacity of a MOLLE ruck or the 2,000 cubic inch "assault pack." However, this is not meant to be limiting and other suitable pack capacities may be used.

In summary, some of the overall benefits include, but are not limited to: 100 lb./3000 cubic inch capacity, incorporation of a quick release mechanism (QRM) allowing for single hand release (left or right) without assistance from a second party, a mission/activity specific pack (modularization) with quick interchangeability before/during mission or activity, custom pouch/storage modularity with MOLLE/PALS webbing for additional (existing) storage, hydration system included, additional ballistic capability, comfort and ergonomically designed.

Certain numerical ranges, capacities, and ratios have been mentioned in this description but are meant to be exemplary in nature and non-limiting.

Certain objects and advantages of the invention are described herein. Of course, it is to be understood that not necessarily all such objects or advantages may be achieved in accordance with any particular embodiment of the invention. Thus, for example, those skilled in the art will recognized that the invention may be embodied or carried out in a manner that achieves or optimizes one advantage or group of advantages as taught herein without necessarily achieving other objects or advantages as may be taught or suggested herein.

It is also contemplated that various combinations or sub-combinations of the specific features and aspects of the embodiments may be made and still fall within the scope of the invention. Accordingly, it should be understood that various features and aspects of the disclosed embodiments may be combined with or substituted for one another in order to form varying modes of the disclosed invention, Thus, it is intended that the scope of the present invention herein disclosed should not be limited by the particular disclosed embodiments described above.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure.

What is claimed is:

1. A quick release modular backpack system for rapidly shedding load bearing components, the system comprising:

a primary load support constructed to be releasably secured to a support surface;

an auxiliary load bearing module;

a quick release mechanism having a first position releasably coupling the auxiliary load bearing module with the primary load support, the quick release mechanism including an actuator constructed to shift the quick release mechanism into a second position with a single motion to completely shed the auxiliary load bearing module from the primary load support while the primary load support is releasably secured to the support surface; and a bladder releasably secured to the primary load support, the bladder being retained on the primary load support even when the auxiliary load bearing module is shed.

2. The quick release modular backpack system of claim 1 wherein:

the quick release mechanism is further constructed to receive a replacement auxiliary load bearing module and couple the replacement auxiliary load bearing module to the primary load support.

3. The quick release modular backpack system of claim 1 wherein:

the primary load support and auxiliary load bearing module define a compartment when coupled together with the bladder residing in the compartment.

4. The quick release modular backpack system of claim 1 wherein:

the quick release mechanism includes a dual catch, single pull assembly.

5. The quick release modular backpack system of claim 1 wherein:

the auxiliary load bearing module is constructed to rotate away from the primary load support when the actuator is engaged and the auxiliary load bearing module and the primary load support are in an upright configuration.

6. The quick release modular backpack system of claim 1 wherein:

the actuator is constructed to decouple the auxiliary load bearing module from the primary load support even when the auxiliary load bearing module and primary load support are in a horizontal orientation.

7. The quick release modular backpack system of claim 1 further comprising:

a pair of adjustable shoulder straps connected to the primary load support to facilitate donning the primary load support, the shoulder straps being retained even when the auxiliary load bearing module is shed from the primary load support.

8. The quick release modular backpack system of claim 1 further comprising:

an adjustable weight belt connected to the primary load support, the weight belt being retained even when the auxiliary load bearing module is shed from the primary load support.

9. The quick release modular backpack system of claim 1 wherein:

the actuator is a pull cable attached to the quick release mechanism and is accessible to be pulled by a user when the primary load support is donned by a user without assistance of a second party.

10. The quick release modular backpack system of claim 1 wherein:

the primary load support and the auxiliary load bearing module are releasably coupled together to form a clamshell.

11. The quick release modular backpack system of claim 1 wherein:

the primary load support includes a first region with the release mechanism and a second region with a pivot point; and the auxiliary load bearing module includes a complementary release component to engage the release mechanism and a complementary pivoting component to engage the pivot point of the primary load support.

12. The quick release modular backpack system of claim 1 further comprising:

a pack releasably coupled to the auxiliary load bearing module, the pack defining at least one interior chamber and including an exterior surface with a webbing to releasably capture a plurality of organizing pouches.

13. The quick release modular backpack system of claim 1 wherein:

aligning the auxiliary load bearing module with the primary load support and coupling to module and load support together results in an audible click when the module and support are releasably coupled together.

14. A method of quickly releasing an auxiliary load module from a primary load support, the method comprising:

providing a primary load support with a set of shoulder straps constructed to be releasably secured to a support surface;

providing an auxiliary load bearing module;

providing a quick release mechanism having a first position releasably coupling the auxiliary load bearing module with the primary load support, the quick release mechanism including an actuator constructed to shift the quick release mechanism into a second position with a single motion to completely shed the auxiliary load bearing module from the primary load support while the primary load support is releasably secured to the support surface;

providing an actuator in communication with the quick release mechanism, the actuator being constructed to disengage the quick release mechanism;

providing a bladder releasably secured to the primary load support;

donning the primary load support;

releasably coupling the auxiliary load bearing module to the primary load support to cover the bladder;

actuating the actuator using a single motion to decouple the auxiliary load bearing module from the primary load support while retaining the primary load support in a donned configuration; and retaining the fluid holding bladder on the primary load support when the auxiliary load bearing module is shed.

15. The method of claim 14 further comprising:

recoupling the auxiliary load bearing module on the primary load support.

16. The method of claim 14 further comprising:

exchanging the auxiliary load bearing module with an alternative auxiliary load bearing module.

17. The method of claim 14 wherein:

the auxiliary load bearing module is pivotally and releasably coupled to the primary load support; and actuating the actuator decouples the auxiliary load bearing module to pivot away from the primary load support.

18. The method of claim 14 further comprising:

locating at least one portion of the actuator proximate a shoulder strap.

19. A quick release modular backpack system comprising:

a wearable chassis having a front surface, a rear surface, a top edge, a bottom edge, a left side edge, a right side edge, a pivot rest, and a left side shoulder strap and a right side shoulder strap with each strap having an upper end and a lower end connected to the chassis and at least one strap including one or more compartments with the straps cooperating to maintain the frame in an upright orientation when donned;

a quick release mechanism including a capturing element positionable between a capturing position and a release position;

an auxiliary load bearing carrier with a support bar releasably and pivotally engaged with the pivot rest of the chassis and at least one capture bar releasably captured by the quick release mechanism, the carrier and chassis defining an internal cavity when releasably coupled together;

an actuator with at least one end extending from the quick release mechanism and disposed proximate at least one shoulder strap wherein the actuator may be grasped by the end and pulled to place the quick release mechanism into a release position and allow the capture bar to separate from the capturing element where continued rotation of the carrier relative to the chassis about the pivot point results in a complete separation of the carrier from the chassis while the chassis is retained when donned; and a bladder releasably secured to the wearable chassis and within the internal cavity, the bladder being retained on the wearable chassis even when the auxiliary load bearing carrier is shed.

20. A quick release modular backpack system comprising:

a primary wearable load support including at least one retention strap constructed to position the chassis in an upright orientation when worn;

an exchangeable auxiliary load module pivotally and releasably coupled to a first region of the primary wearable load support to define a first interior storage compartment;

a pack releasably coupled to the auxiliary load module, the pack defining a second interior storage compartment and including a webbing constructed to receive one or more organizational pouches;

a quick release mechanism releasably coupling the auxiliary load module to a second region of the primary load support;

an actuator in communication with the quick release mechanism, the actuator being constructed to selectively decouple the quick release mechanism with one or more motions by the wearer of the primary load support to rotationally shed the auxiliary load bearing module away from and completely off the primary wearable load support while retaining the primary load support when worn; and a bladder releasably secured to the primary wearable load support within the first interior storage compartment when the auxiliary load module is coupled to the primary wearable load support, the bladder being retained on the primary wearable load support even when the auxiliary load module is shed.

* * * * *